US010568418B2

(12) United States Patent
Applegate et al.

(10) Patent No.: US 10,568,418 B2
(45) Date of Patent: Feb. 25, 2020

(54) VARIABLE HEIGHT PLATFORM SYSTEM

(71) Applicant: FELLOWES, INC., Itasca, IL (US)

(72) Inventors: Shawn Michael Applegate, Streamwood, IL (US); Tai Hoon K. Matlin, Round Lake Beach, IL (US); James Edward Losser, St. Charles, IL (US); Mark R. Gartz, Mount Prospect, IL (US); Peter Maletich, Chicago, IL (US); Dipan Pravin Surati, Des Plaines, IL (US); Vadim Romanovich, Glen Ellyn, IL (US)

(73) Assignee: FELLOWES, INC., Itasca, IL (US)

( * ) Notice: Subject to any disclaimer, the term of this patent is extended or adjusted under 35 U.S.C. 154(b) by 0 days.

(21) Appl. No.: 16/003,751

(22) Filed: Jun. 8, 2018

(65) Prior Publication Data

US 2019/0082823 A1 Mar. 21, 2019

Related U.S. Application Data

(60) Provisional application No. 62/559,843, filed on Sep. 18, 2017.

(51) Int. Cl.
*A47B 13/00* (2006.01)
*A47B 3/08* (2006.01)
(Continued)

(52) U.S. Cl.
CPC ..... *A47B 13/003* (2013.01); *A47B 3/08* (2013.01); *A47B 3/12* (2013.01); *A47B 9/00* (2013.01);
(Continued)

(58) Field of Classification Search
CPC ..... A47B 3/08; A47B 3/12; A47B 13/003; A47B 1/08; A47B 9/00; A47B 2200/0057;
(Continued)

(56) References Cited

U.S. PATENT DOCUMENTS

D142,211 S * 8/1945 Glukes ..... 108/157.18
3,049,388 A * 8/1962 Browne ..... A47B 13/08 108/157.18
(Continued)

FOREIGN PATENT DOCUMENTS

CN 203776371 U 8/2014
EP 2926688 A1 10/2015
(Continued)

OTHER PUBLICATIONS

International Search Report and Written Opinion dated Aug. 1, 2018 in International Application PCT/US2018/036678.
(Continued)

*Primary Examiner* — Jose V Chen
(74) *Attorney, Agent, or Firm* — Pillsbury Winthrop Shaw Pittman LLP

(57) ABSTRACT

A variable height platform system comprises a frame assembly, at least two leg assemblies, a drive mechanism, and a sensor. The frame assembly is configured to support and be removably connected to a tabletop. The drive mechanism is configured to either extend or retract each leg assembly in a direction substantially perpendicular to the longitudinal axis to set a height of the frame assembly in an elevated position for use. The sensor is configured to sense position and movement of a user in a predetermined area including an area of the variable height platform system and an area proximate the variable height platform system. The controller is operatively connected to the sensor and drive mechanism. The controller is configured to operate the drive mechanism in response to the sensor sensing the position and movement of the user in the predetermined area.

20 Claims, 22 Drawing Sheets

(51) Int. Cl.
*A47B 3/12* (2006.01)
*A47B 9/00* (2006.01)
*A47B 21/02* (2006.01)

(52) U.S. Cl.
CPC ..... *A47B 21/02* (2013.01); *A47B 2200/0062* (2013.01)

(58) Field of Classification Search
CPC .... A47B 2200/0062; A47B 2003/0824; A47B 2009/043
USPC ..... 108/147, 144.1, 147.19, 147.22, 144.11; 248/188.1, 188.5, 188.6
See application file for complete search history.

(56) References Cited

U.S. PATENT DOCUMENTS 4,651,652 A 3/1987 Wyckoff
5,174,223 A 12/1992 Nagy et al.
5,224,429 A 7/1993 Borgman et al.
6,352,037 B1* 3/2002 Doyle ..... A47B 9/00 108/147
6,401,631 B1 6/2002 Kane et al.
7,908,981 B2 3/2011 Agee
8,413,594 B2 4/2013 Ensley
9,271,567 B2 3/2016 Wu
9,486,070 B2 11/2016 Labrosse et al.
2002/0046684 A1* 4/2002 Lin ..... A47B 3/0815 108/133
2009/0078171 A1* 3/2009 Frost ..... A47B 9/00 108/50.02
2011/0168064 A1* 7/2011 Jahnsen ..... A47B 9/00 108/147
2013/0199419 A1* 8/2013 Hjelm ..... A47B 9/00 108/20
2014/0096706 A1 4/2014 Labrosse et al.
2015/0120238 A1* 4/2015 Marvit ..... A47B 9/00 702/152
2016/0051042 A1 2/2016 Koch
2016/0260019 A1* 9/2016 Riquelme Ruiz .... A47B 21/007
2016/0309889 A1* 10/2016 Lin ..... A47B 9/00
2016/0345722 A1* 12/2016 Chen ..... A47B 9/04
2017/0052517 A1* 2/2017 Tsai ..... A47B 9/00
2017/0135466 A1* 5/2017 Randlov ..... A47B 9/20
2017/0135587 A1* 5/2017 Desroches ..... G16H 20/30
2017/0164728 A1* 6/2017 Chang ..... A47B 13/06
2017/0251802 A1* 9/2017 Lu ..... A47B 3/06
2017/0303679 A1* 10/2017 Tseng ..... A47B 9/04
2017/0347792 A1* 12/2017 Bergmann ..... F16B 12/10
2018/0000240 A1* 1/2018 Yamamoto ..... A47B 9/20
2018/0020831 A1* 1/2018 Lenz ..... A47B 9/00 297/174 R
2018/0103753 A1* 4/2018 Davidsen ..... A47B 1/08
2018/0110324 A1 4/2018 Keller et al.
2018/0242728 A1* 8/2018 Hansen ..... A47B 3/0818
2018/0344023 A1* 12/2018 Andersson ..... A47B 1/08
2019/0029412 A1* 1/2019 Gibson ..... A47B 9/00
2019/0029413 A1* 1/2019 Patton ..... A47B 9/20
2019/0098994 A1* 4/2019 Smed ..... A47B 21/02

FOREIGN PATENT DOCUMENTS

EP 2979579 A1 2/2016
EP 3311693 A1 4/2018

OTHER PUBLICATIONS

Written Opinion dated Aug. 26, 2019 in International Application PCT/US2018/036678.

* cited by examiner

VARIABLE HEIGHT PLATFORM SYSTEM

CROSS-REFERENCE TO PRIOR APPLICATION

This application claims benefit to U.S. Patent Application 62/559,843 filed Sep. 18, 2017, the contents of which are incorporated herein in their entirety.

BACKGROUND

Field

The present patent application relates to sit stand products, more specifically, to desks and table like sit stands with manual and motorized lift assisted legs.

Description of Related Art

A related group of products are desk or table based sit stand systems. In these sit stand systems, the entire work surface moves up and down utilizing telescoping legs that retract and extend causing the main surface of the desk or table to lower and raise. For example, these types of systems are described in the following patents: U.S. Pat. No. 4,651,652—a desk utilizing a pulley and gas spring actuated legs; U.S. Pat. No. 5,174,223—an ergonomic computer workstation which engages users in various sit stand positions; U.S. Pat. No. 5,224,429—supporting work station with front and back tops with separate powered drives and a controller with memory function); and U.S. Pat. No. 9,486,070—Sit/Stand table with power drive, controller with inputs, ultra-sonic range finder or Passive Infrared (PIR) detector utilizing below the table detection. There are many other types of systems including crank operated tables that have been in the public domain for many years. This is only a sample list of table and desk based Sit/Stand systems that endeavor to support an individual's ergonomic health and general well-being.

As more and more sit/stand systems are coming onto the market, and there has been a heightened awareness that sitting for prolonged periods of time without an active movement break of some kind can be harmful, office workers have taken notice and requested sit/stand type systems to be available in the workplace. As businesses incorporate these types of systems at the workplaces, there has been several issues that have developed in the market place. Since sit stand table systems are complex in construction as compared to standard desks and tables used in a typical office, the time and difficulty assembling and setting up these systems may become noticeably prohibitive in regard to the time and labor costs expended by the business to assemble and set up these units. Another potential issue that may arise is keeping with the unified décor of an office or business; by bringing in one or two or several of these systems into the workplace, a non-cohesive office décor issue may exist. Potentially due to that, the business may discourage the purchase of these systems until the entire office is refurnished or remodeled. Furthermore, if a company or business wishes to keep to a unified look, they would have to refurbish their entire office with a particular limited offering and be stuck with a basic limited pallet of finishes and colors typically offered by the distributors. In addition, if a company or business were to take the initiative to refurbish the entire office, there is a lack of differing or customization options offered within a reasonable price range that businesses can take advantage of. Finally, through research, there has been general acceptance by those whom have yet to agree sit/stand systems are proven to be beneficial, that taking periodic breaks and moving about the office is a healthy practice.

The present patent application endeavors to provide various improvements over prior mentioned examples along with any similar examples that may not have been mentioned or included. The present patent application discloses a device that takes into consideration these important observations noted above and solves them in a manner to be unique and beneficial to those seeking these types of systems in the market.

BRIEF SUMMARY

In one embodiment of the present patent application, a variable height platform system is provided. The variable height platform system comprises a frame assembly, at least two leg assemblies, a drive mechanism, and a connector assembly. The frame assembly extends longitudinally along a longitudinal axis. The frame assembly is configured to support and be removably connected to one of a plurality of different tabletops. The frame assembly is configured to be adjustable along the longitudinal axis to accommodate the plurality of different tabletops. The size of a first of the plurality of different tabletops is different from the size of a second of the plurality of different tabletops. Each leg assembly is configured to be pivotally connected to a portion of the frame assembly. Each leg assembly is configured to be movable between a deployed position in which each leg assembly is configured to be substantially perpendicular to the longitudinal axis of the frame assembly so as to support the frame assembly in an elevated position for use, and a storage position in which each leg assembly is configured to be folded flat against the frame assembly and parallel to the longitudinal axis of the frame assembly. The drive mechanism is configured to either extend or retract each leg assembly in a direction substantially perpendicular to the longitudinal axis to set a height of the frame assembly in the elevated position. The connector assembly is disposed on the frame assembly and configured to detachably lock one of the plurality of different tabletops to the frame assembly. The plurality of different tabletops are interchangeable such that the first of the plurality of different tabletops, detachably locked to the frame assembly by the connector assembly, is removed from the frame assembly by unlocking the connector assembly, the frame assembly is then adjusted along the longitudinal axis to accommodate the second of the plurality of different tabletops, and the second of the plurality of different tabletops is positioned on the frame assembly and detachably locked to the frame assembly by the connector assembly.

In another embodiment of the present patent application, a variable height platform system is provided. The variable height platform system comprises a tabletop, a frame assembly, at least two leg assemblies, a drive mechanism, a sensor and a controller. The frame assembly extends longitudinally along a longitudinal axis. The frame assembly is configured to support and be removably connected to the tabletop. Each leg assembly is configured to be connected to a portion of the frame assembly. The drive mechanism is configured to either extend or retract each leg assembly in a direction substantially perpendicular to the longitudinal axis to set a height of the frame assembly in an elevated position for use. The sensor is configured to sense position and movement of a user in a predetermined area including an area of the variable height platform system and an area proximate the variable height platform system. The controller is operatively connected to the sensor and drive mechanism. The controller is configured to operate the drive mechanism in response to the sensor sensing the position and movement of the user in the predetermined area.

In yet another embodiment of the present patent application, a variable height platform system is provided. The variable height platform system comprises a tabletop, a frame assembly, at least two leg assemblies, a drive mechanism, a sensor and a controller. The frame assembly extends longitudinally along a longitudinal axis. The frame assembly is configured to support and be removably connected to the tabletop. Each leg assembly is configured to be connected to a portion of the frame assembly. The drive mechanism is configured to either extend or retract each leg assembly in a direction substantially perpendicular to the longitudinal axis to set a height of the frame assembly in an elevated position for use. The sensor is configured to sense position and movement of a user in a predetermined area that is on the tabletop and proximate the tabletop. The controller is operatively connected to the sensor and drive mechanism. The controller is configured to operate the drive mechanism in response to the sensor sensing the position and movement of the user in the predetermined area.

In yet another embodiment of the present patent application, a variable height platform system is provided. The variable height platform system comprises a tabletop, a frame assembly, at least two leg assemblies, a drive mechanism, and a capacitive sensor. The frame assembly extends longitudinally along a longitudinal axis and is configured to support and be removably connected to the tabletop. Each leg assembly is configured to be connected to a portion of the frame assembly. The drive mechanism is configured to either extend or retract each leg assembly in a direction substantially perpendicular to the longitudinal axis to set a height of the frame assembly in an elevated position for use. The capacitive sensor is configured to sense position and movement of a user in a predetermined three-dimensional region proximate the tabletop. The controller is operatively connected to the capacitive sensor and drive mechanism. The controller is configured to operate the drive mechanism in response to the capacitive sensor sensing the position and movement of the user in the predetermined three-dimensional region.

In yet another embodiment of the present patent application, a variable height platform system is provided. The variable height platform system comprises a frame assembly, at least two leg assemblies, a drive mechanism, and an overcenter latch. The frame assembly extends longitudinally along a longitudinal axis and is configured to support and be removably connected to a tabletop. Each leg assembly is configured to be pivotally connected to a portion of the frame assembly. Each leg assembly is configured to be movable between a deployed position in which each leg assembly is configured to be substantially perpendicular to the longitudinal axis of the frame assembly so as to support the frame assembly in an elevated position for use, and a storage position in which each leg assembly is configured to be folded flat against the frame assembly and parallel to the longitudinal axis of the frame assembly. The drive mechanism is configured to either extend or retract each leg assembly in a direction substantially perpendicular to the longitudinal axis to set a height of the frame assembly in the elevated position. The overcenter latch comprises a latch member and a latch handle. The overcenter latch is configured to be biased into a lock position wherein the latch member releasably engages with a lock engagement portion of an associated leg assembly, when that leg assembly in its deployed position, so as to lock the associated leg assembly in its deployed position. A movement of the latch handle from a first position to a second position is configured to further secure the engagement between the latch member and the latch engagement portion These and other aspects of the present patent application, as well as the methods of operation and functions of the related elements of structure and the combination of parts and economies of manufacture, will become more apparent upon consideration of the following description with reference to the accompanying drawings, all of which form a part of this specification, wherein like reference numerals designate corresponding parts in the various figures. In one embodiment of the present patent application, the structural components illustrated herein are drawn to scale. It is to be expressly understood, however, that the drawings are for the purpose of illustration and description only and are not intended as a definition of the limits of the present patent application. It shall also be appreciated that the features of one embodiment disclosed herein can be used in other embodiments disclosed herein. As used in the specification and in the claims, the singular form of "a", "an", and "the" include plural referents unless the context clearly dictates otherwise. In addition, as used in the specification and the claims, the term "or" means "and/or" unless the context clearly dictates otherwise. It should also be appreciated that some of the components and features discussed herein may be discussed in connection with only one (singular) of such components, and that additional like components which may be disclosed herein may not be discussed in detail for the sake of reducing redundancy.

Other aspects, features, and advantages of the present patent application will become apparent from the following detailed description, the accompanying drawings, and the appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION OF THE DRAWINGS

Figure 1:
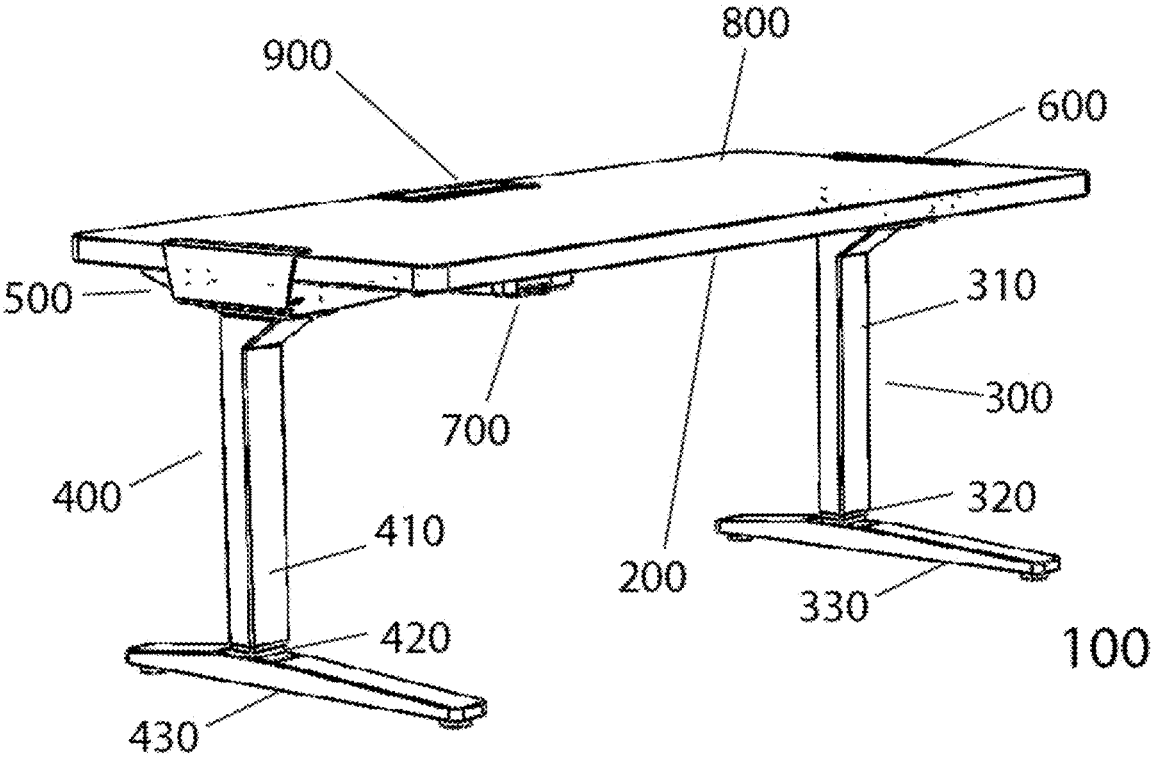
FIG. 1 shows a perspective view of the variable height platform system in accordance with an embodiment of the present patent application.
Figure 2:
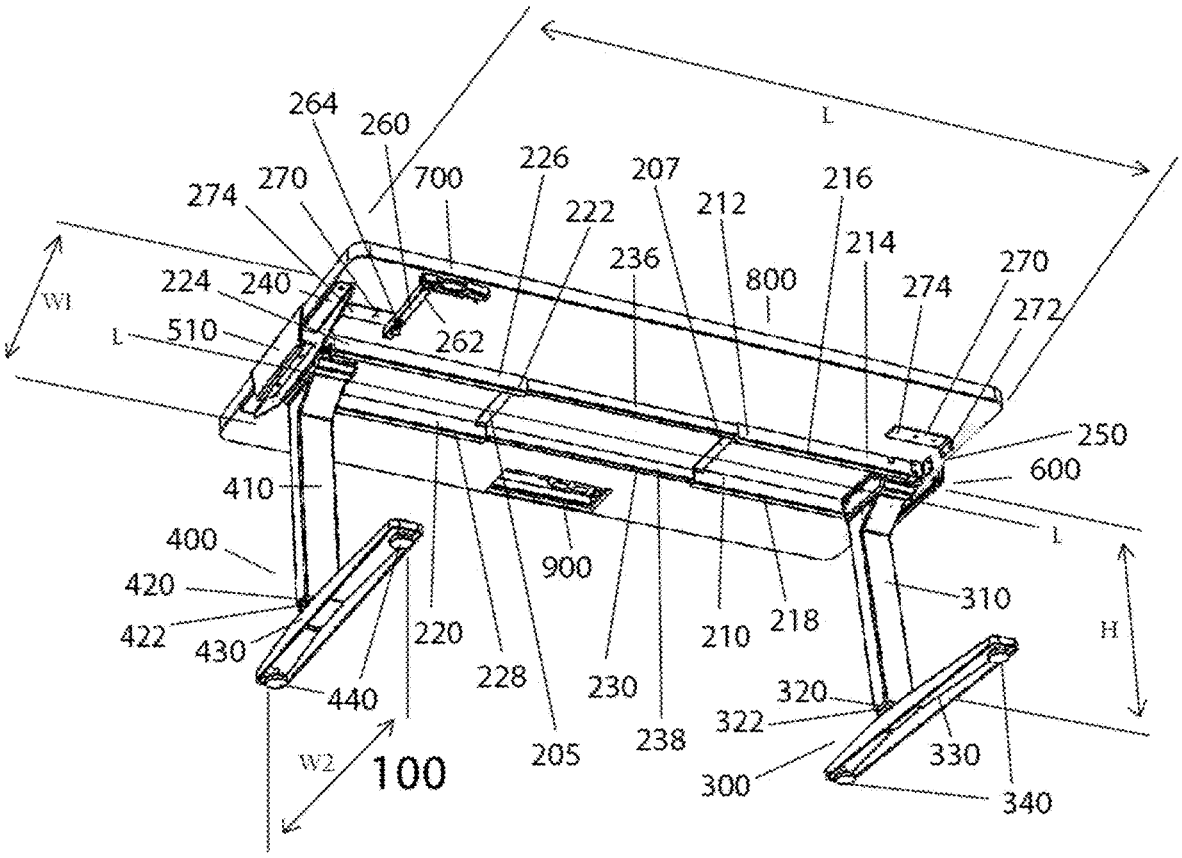
FIG. 2 shows another perspective (underside) view of the variable height platform system in accordance with an embodiment of the present patent application.
Figure 4:
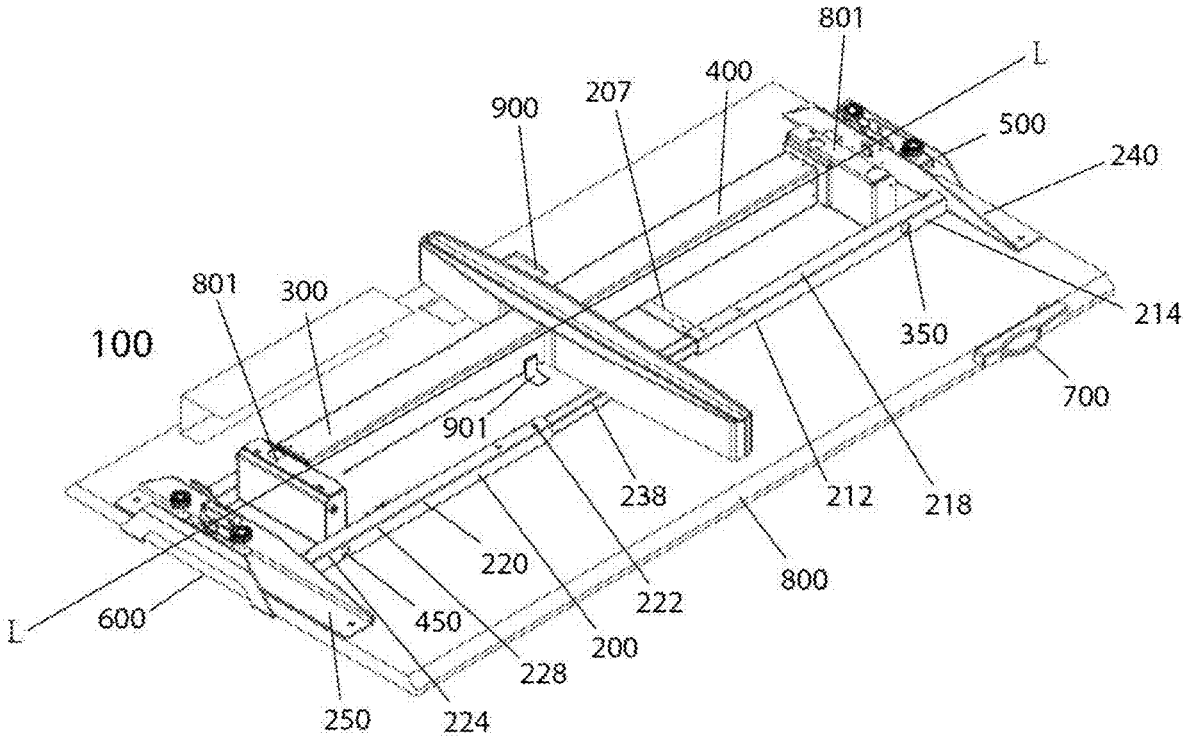
FIG. 4 shows a perspective view of the variable height platform system in a folded, storage, shipping or closed position in accordance with an embodiment of the present patent application.

Referring to FIGS. 1, 2, and 4, a variable height platform system 100 includes a frame assembly 200 that extends longitudinally along a longitudinal axis L-L, and at least two leg assemblies 300 and 400. Each leg assembly 300 or 400 is configured to be connected to a portion of the frame assembly 200. The frame assembly 200 is configured to support and be removably connected to one of a plurality of different tabletops 800. Each leg assembly 300 or 400 is configured to be movable between a deployed position in which each leg assembly 300 or 400 is configured to be substantially perpendicular to the longitudinal axis L-L of the frame assembly 200 so as to support the frame assembly 200 in an elevated position for use, and a storage position in which each leg assembly 300 or 400 is configured to be folded flat against the frame assembly 200 and essentially parallel to the longitudinal axis L-L of the frame assembly 200. In one embodiment, the variable height platform system 100 also includes a drive mechanism 801 (as shown in FIG. 4) configured to either extend or retract each leg assembly 300 or 400 in a direction substantially perpendicular to the longitudinal axis L-L to set a height of the frame assembly 200 in the elevated position.

In one embodiment, the frame assembly 200 is configured to be adjustable along the longitudinal axis L-L to accommodate the plurality of different tabletops 800. The size of a first of the plurality of different tabletops 800 is different from the size of a second of the plurality of different tabletops 800. In one embodiment, the variable height platform system 100 includes a connector assembly 500, 600. The connector assembly 500, 600 is disposed on the frame assembly 200 and configured to detachably lock one of the plurality of different tabletops 800 to the frame assembly 200. The plurality of different tabletops 800 are interchangeable such that the first of the plurality of different tabletops 800, detachably locked to the frame assembly 200 by the connector assembly 500, 600, is removed from the frame assembly 200 by unlocking the connector assembly 500, 600. The frame assembly 200 is then adjusted along the longitudinal axis L-L to accommodate the second of the plurality of different tabletops 800. The second of the plurality of different tabletops 800 is positioned on the frame assembly 200 and detachably locked to the frame assembly 200 by the connector assembly 500, 600. In one embodiment, the connector assembly 500, 600 is permanently attached to the frame assembly 200. In one embodiment, the connector assembly 500, 600 is guided by the frame assembly 200.

In one embodiment, the variable height platform system 100 includes at least two latches 302. Each latch 302 is configured to be biased into a lock position wherein it releasably engages with a lock engagement portion 314 of an associated leg assembly 300 when that leg assembly 300 in its deployed position. Each latch 302 includes an eccentrically mounted latch member 362 and a latch handle 372. The eccentrically mounted latch member 362 is configured to releasably engage with the lock engagement portion 314 of the associated leg assembly 300, when that leg assembly 300 in its deployed position, so as to lock the associated leg assembly 300 in its deployed position. In one embodiment, a movement of the latch handle 372 from a first position to a second position is configured to further secure the engagement between the latch member 362 and the latch engagement portion 314. In one embodiment, the latch 302 is referred to as an overcenter latch.

In one embodiment, the variable height platform system 100 includes a retainer assembly 901 that is configured to releasably engage with a portion of an associated leg assembly 300 or 400 when that leg assembly 300 or 400 in its storage position so as to lock that leg assembly 300 or 400 in its storage position.

In one embodiment, a length of the first of the plurality of different tabletops 800 is different from a length of the second of the plurality of different tabletops 800. In one embodiment, the lengths of the first and the second of the plurality of different tabletops 800 are measured along the longitudinal axis L-L. In one embodiment, a width of the first of the plurality of different tabletops 800 is the same as a width of the second of the plurality of different tabletops 800. In one embodiment, the widths of the first and the second of the plurality of different tabletops 800 are measured perpendicular to the longitudinal axis L-L. In one embodiment, a width of the first of the plurality of different tabletops is different from a width of the second of the plurality of different tabletops 800. The widths of the first and the second of the plurality of different tabletops 800 are measured perpendicular to the longitudinal axis L-L. In one embodiment, the connector assembly 500, 600 is configured to be adjustable, in a direction perpendicular to the longitudinal axis L-L, to accommodate the different widths of the first and the second of the plurality of different tabletops 800.

Figure 19:
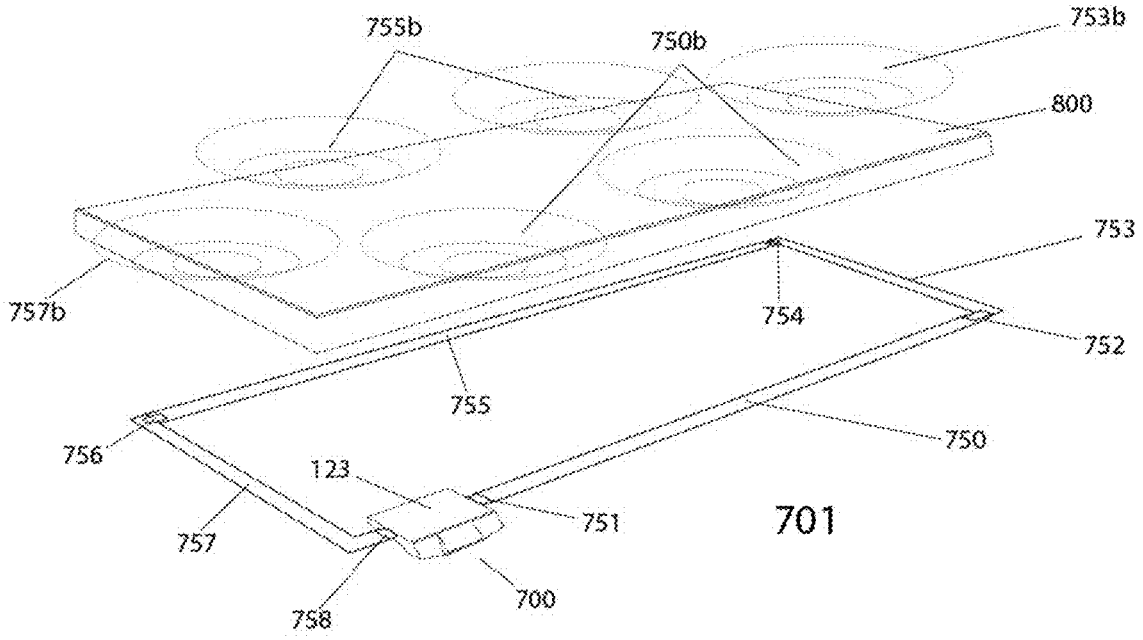
FIG. 19 shows a perspective view of a capacitive based sensor array arrangement of the variable height platform system in accordance with an embodiment of the present patent application.
Figure 20:
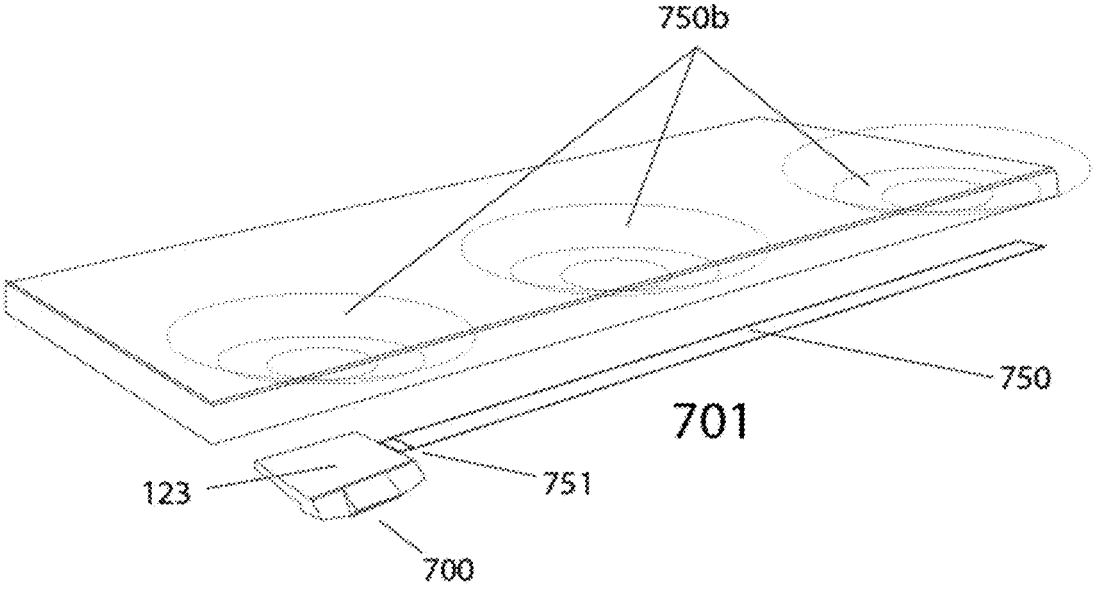
FIG. 20 shows a perspective view of the capacitive based sensor array arrangement of the variable height platform system in accordance with another embodiment of the present patent application.

In one embodiment, the variable height platform system 100 includes a sensor 701 (as shown in FIGS. 19 and 20). The sensor 701 is configured to sense position and movement of a user in a predetermined area including an area of the variable height platform system 100 and an area proximate the variable height platform system 100. The controller 123 is operatively connected to the sensor 701 and drive mechanism 801. The controller 123 is configured to operate the drive mechanism 801 in response to the sensor 701 sensing the position and movement of the user in the predetermined area.

In one embodiment, the sensor 701 is configured to sense position and movement of a user in a predetermined area that is on the tabletop 800 and proximate the tabletop 800. In one embodiment, the sensor 701 is a capacitive sensor.

In one embodiment, the sensor 701 is configured to sense the position and movement of the user on the tabletop 800, along a length of the tabletop 800 and a width of the tabletop 800. In one embodiment, the sensor 701 is disposed on an underside of the tabletop 800 and the sensor 701 is configured to sense the position and movement of the user through a thickness of the tabletop 800. In one embodiment, the sensor 701 is configured to sense the position and movement of the user across an area of the tabletop 800. In one embodiment, the sensor 701 is disposed on a top surface portion of the frame assembly 200 and the sensor 701 is configured to sense the position and movement of the user through a thickness of the tabletop 800. In one embodiment, the sensor 701 is a capacitive sensor.

In one embodiment, the variable height platform system 100 includes a capacitive sensor 701 (as shown in FIGS. 19 and 20). The capacitive sensor 701 is configured to sense position and movement of a user in a predetermined three-dimensional region proximate the tabletop 800. The controller 123 is operatively connected to the capacitive sensor 701 and drive mechanism 801. The controller 123 is configured to operate the drive mechanism 801 in response to the capacitive sensor 701 sensing the position and movement of the user in the predetermined three-dimensional region. In one embodiment, the predetermined three-dimensional region includes an area that is on the tabletop 800.

FIGS. 1 and 2 show the variable height platform system 100, with the tabletop 800 supported thereon, where the leg assemblies 300 and 400 are in their deployed positions and the frame assembly 200 is in its elevated position. FIG. 4 shows the variable height platform system 100, with the tabletop 800 supported thereon, where the leg assemblies 300 and 400 are in their storage positions. As will be explained in the disclosure below, the variable height platform system 100 is configured to be easily foldable and transportable.

The variable height platform system 100, without the tabletop 800 supported thereon, has a width dimension $W_1$ that may generally range from about 18 inches to about 22 inches, and a width dimension $W_2$ that may generally range from about 25 inches to about 30 inches. The variable height platform system, without the tabletop 800 supported thereon, may generally weigh from about 50 pounds to about 70 pounds. The variable height platform system 100, without the tabletop 800 supported thereon, has a height dimension, H that may generally range from about 25 inches to about 50 inches (from retracted to fully extended). The height dimension, H is measured here when clamp assemblies or connectors 500, 600 (described in detail below) are in their most retracted positions. The variable height platform system 100, without the tabletop 800 supported thereon, has a length dimension, L that may generally range from about 46 inches to about 72 inches (from retracted to fully extended).

As shown in the FIGS. 1, 2 and 4, the tabletop (or desktop) 800 has a rectangular shaped configuration. The tabletop (or desktop) 800 may have a square shaped configuration. However, it is contemplated that the tabletop may have other sizes, shapes or configurations that would be appreciated by one skilled in the art.

The tabletop 800 may be formed from a glass material (e.g., tempered glass). The tabletop 800 may be formed from a wood material. The tabletop 800 may be formed from a plastic material. The tabletop 800 may be formed from a composite material. The tabletop 800 may be formed from Medium-density fiberboard (MDF) material. The tabletop 800 may be formed from laminated plywood material. The tabletop 800 may be formed from ceramic material. The tabletop 800 may be formed from natural stone material. The tabletop 800 may be formed from metal material.

The frame assembly 200 and the leg assembly 300, 400 may be formed from a metal material. The frame assembly 200 and the leg assembly 300, 400 may be formed from steel material. The frame assembly 200 and the leg assembly 300, 400 may be formed from aluminum material. The frame assembly 200 and the leg assembly 300, 400 may be formed from a plastic material. The frame assembly 200 and the leg assembly 300, 400 may be formed from a composite material.

As shown in FIGS. 1 and 2, the variable height platform system 100 may include a cord management grommet assembly 900. The cord management grommet assembly 900 may have cord management gutters attached. Modular components that fit into the cord management grommet assembly 900 may include cords such as USB cords, power cords, and phone charge cords, or any other additional cords. The cord management grommet assembly 900 may also include USB connectors, power sockets, wireless charging modules, etc. The variable height platform system 100 may also include a power switch and other electrical contacts for connecting a power cord from a source of electricity for operation of the variable height platform system 100. Typically, the power supply will be a standard power cord with a plug on its end that plugs into a standard AC outlet.

The variable height platform system 100 may also include an optional frame wheel assembly to facilitate easier transportation of the closed position frame assembly from one place to another, for example, for temporary breakdown and quick set up. For example, the optional frame wheel assembly may be attached to one end of base members 330, 430, while the other end of the base members 330, 430 may have leveling members or stabilizers.

The frame assembly 200 is configured to be adjustably assembled. Attached to the supportive frame assembly 200 by way of a hinging assembly (350 in FIG. 3) are the at least two telescoping lift assisted supportive leg assemblies 300, 400 that are configured to be folded substantially flat against the frame assembly 200 by the hinging assembly and that are configured to be retained in the flat or closed position. The lift assisted supportive leg assemblies 300, 400, when released from a retainer mechanism 901 (as shown in FIG. 4), are configured to be folded open to a substantially perpendicular position from the frame assembly 200 and are configured to be secured by a mechanical means (e.g., latch shown in FIGS. 13-15). In one embodiment, the retainer mechanism 901 may be any mechanism as would be appreciated by one skilled in the art that is configured to lock the leg assemblies 300, 400 in their storage position or shipping position.

Referring to FIG. 2, the frame assembly 200 includes a center frame portion 230, a right frame portion 210 and a left frame portion 220. The frame assembly 200 may also include cross members 205 and 207 extending perpendicular to the longitudinal axis L-L. The number of cross members the frame assembly 200 may vary.

Each of the center frame portion 230, the right frame portion 210 and the left frame portion 220 are integrally formed. Each of the right frame portion 210, the center frame portion 230, and the left frame portion 220 includes generally hollow members. Each of the right frame portion 210, the center frame portion 230, and the left frame portion 220 have members having generally similar cross-sectional configuration but slightly larger or smaller to slidably/telescopically mate with the other members of the right frame portion 210, the center frame portion 230, and the left frame portion 220.

The right frame portion 210 may include elongated, spaced apart, generally parallel tubular members 216 and 218 that extend along the longitudinal axis L-L. The left frame portion 220 may include elongated, spaced apart, generally parallel tubular members 226 and 228 that extend along the longitudinal axis L-L. The center frame portion 230 may include elongated, spaced apart, generally parallel tubular members 236 and 238 that extend along the longitudinal axis L-L. The number of members in each of the right frame portion 210, the left frame portion 220 and the center frame portion 230 may vary.

The frame assembly 200 has a slidably adjustable set up allowing the same frame assembly 200 to accommodate various width tabletops 800. The frame assembly 200 is configured to be longitudinally extendable to enable the same frame assembly 200 to support various sized (e.g., different lengths) tabletops 800 thereon. That is, the frame assembly 200 is configured to be adjustable in length along the longitudinal axis L-L. In one embodiment, the frame portions 210, 230 and 220 are assembled in a way as to allow the frame portions 210 and 220 telescope outwardly from each other. Once the frame assembly 200 has been expanded to generally match the length of the tabletop 800, and once the tabletop 800 is mounted, the frame length then is locked in place.

The right frame portion 210 is configured to be adjustably/movably connected to the center frame portion 230 at one end portion 212 thereof and is connected to the right leg assembly 300 at the other end portion 214 thereof. The left frame portion 220 is configured to be adjustably/movably connected to the center frame portion 230 at one end portion 222 thereof and is connected to the left leg assembly 400 at the other end portion 224 thereof.

The right frame portion 210 and the left frame portion 220 may both be configured to be movable and adjustable longitudinally along the longitudinal axis L-L and with respect to the center frame portion 230. One of the right frame portion 210 and the center frame portion 230 is constructed and arranged to be received by and extending in and out of other of the right frame portion 210 and the center frame portion 230 to facilitate longitudinal telescopic movement between the right frame portion 210 and the center frame portion 230. Similarly, one of the left frame portion 220 and the center frame portion 230 is constructed and arranged to be received by and extending in and out of other of the left frame portion 220 and the center frame portion 230 to facilitate longitudinal telescopic movement between the left frame portion 220 and the center frame portion 230.

The right frame portion 210 and the left frame portion 220 are both configured to be secured (e.g., with the center frame portion 230) in a selected one of a plurality of longitudinally extended or retracted positions. The frame assembly 200 may include a lock assembly that is configured to selectively lock the right frame portion 210 and the left frame portion 220 (e.g., with the center frame portion 230) at one of a plurality of longitudinally extended or retracted positions. The lock assembly may include a bias member that is constructed and arranged to lock the lock assembly at a selected position and to prevent relative movement between the right frame portion 210 and the center frame portion 230 or between the left frame portion 220 and the center frame portion 230. The lock assembly may have a (spring bias) lock member and associated lock member engaging structure (in the form of holes, grooves, openings or notches to engage with the lock member). As would be appreciated by one of skill in the art, various suitable lock assemblies having different constructions and operations may be used in the present patent application to selectively lock the right frame portion 210 and the left frame portion 220 (e.g., with the center frame portion 230) at one of a plurality of longitudinally extended or retracted positions.

The frame assembly 200 may have an actuator that is easily accessible to the user/operator of the variable height platform assembly 100. The actuator is configured to actuate the lock assembly to selectively lock the right frame portion 210 and the left frame portion 220 (e.g., with the center frame portion 230) at one of a plurality of longitudinally extended or retracted positions.

Referring to FIGS. 2 and 4, the frame assembly 200 also includes left platform/tabletop support bracket 240 and right platform/tabletop support bracket 250. The left platform/tabletop support bracket 240 is connected to the left frame portion 220 at the end portion 224. The right platform/tabletop support bracket 250 is connected to the right frame portion 210 at the end portion 214.

The frame assembly 200 also includes adjustable mount bracket(s) 270. The adjustable mount bracket 270 may have an L-shaped configuration. The left and right adjustable mount brackets 270 are connected to the left platform/tabletop support bracket 240 and the right platform/tabletop support bracket 250, respectively at their end portions 272 thereof. The adjustable mount brackets 270 may be connected to the tabletop 800, supported on the frame assembly 200, along their length portions 274.

The frame assembly 200 also includes control panel mount bracket 260. The control panel mount bracket 260 is configured to mount a user interface/control panel 700 to the frame assembly 200. One end 262 of the control panel mount bracket 260 is configured to be connected to the user interface/control panel 700 and the other end 264 of the control panel mount bracket 260 is configured to be connected to the adjustable mount bracket 270.

The height of the frame assembly 200 is adjustable when the frame assembly 200 is in the elevated position. That is, when the frame assembly 200 is in the elevated position, the height of the frame assembly 200 may be adjustable to a plurality of different height positions by the telescopic leg assemblies 300, 400.

In combination, the frame assembly 200 incorporates by way of a hinged assembly (350 in FIG. 3) the lift assisting telescoping leg assemblies 300, 400. The hinging assembly allows the leg assemblies 300, 400 to fold inwardly and substantially flat against the frame assembly 200. The hinged leg assemblies 300, 400 when folded inwardly in the closed position has a retainer assembly/mechanism 901 such as a latch, pin, knurled screw and/or strong detent to keep the leg assemblies 300, 400 in the closed or folded position for ease of movement temporarily (e.g., from room to room) or for ease of shipping. Optionally, if a tabletop has been pre-assembled to the frame assembly 800, once shipped to a location, set-up is very easy. Simple unpack, release the retainer assembly/mechanism 901, fold open by way of the hinge pin, each leg assemblies 300, 400 to the open position that is substantially perpendicular to the frame and securely latch into place. The variable height platform system 100, thus, can easily be set up with no tools required.

The frame assembly 200 is also configured to retain two clamp mechanisms 500, 600 on at least two opposing sides of the frame assembly 200. As will be clear from the discussions below, the clamp mechanisms 500, 600 are configured to hold securely in place when tightened, a substantially sized surface used as a desktop or tabletop 800.

Referring to FIG. 4, the drive mechanism 801 (e.g., motor) is configured to provide power to extend or retract the leg assemblies 300, 400 in a direction substantially perpendicular to the longitudinal axis to set a height of the frame assembly 200 in the elevated position. That is, the drive mechanism 801 is configured to adjust the height of the frame assembly 200 from the floor. The drive mechanism 801 includes an electric motor. The motor may be a brushless DC motor. In other embodiments, the drive mechanism 801 includes a battery operated motor or other drive mechanisms that are configured to provide power to extend or retract the leg assemblies 300, 400. The drive mechanism 801 includes a drive shaft (threaded screw). The drive mechanism 801 may also include gears and pinions to connect the motor output shaft to the drive shaft. The drive shaft is connected to one of the telescopic leg members to extend or retract that leg member (with respect to the other leg member of the leg assembly 300, 400) as the drive shaft is rotated by the motor.

In another embodiment, the drive mechanism 801 may include a hydraulic mechanism, pneumatic mechanism, pressurized gas mechanism or mechanical mechanism (e.g., screw shaft assembly) for adjusting the vertical height of the frame assembly 200 from the floor. The drive mechanism 801 may include a pneumatic cylinder assembly (i.e., gas charged piston). In one embodiment, the adjustment of the height of the frame assembly 200 from the floor also adjusts the height of the tabletop 800, supported on the frame assembly 200, from the floor.

Figure 21:
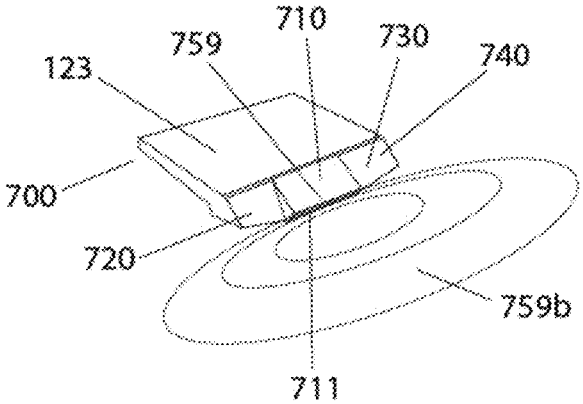
FIG. 21 shows a perspective view of the control panel/user interface assembly in accordance with an embodiment of the present patent application.

The variable height platform system 100 may also include a built-in power supply that is configured to power the drive mechanism 801. Also, as will be described below, the drive mechanism 801 is in communication with a sensor 701 (as shown in FIGS. 19-20) and a controller 123 (as shown in FIGS. 19-21) of the variable height platform system 100. The controller 123 is configured to receive the sensor data and compare the sensor data with its corresponding predetermined threshold. The controller 123, based on the comparison of the sensor data with its corresponding predetermined threshold, is configured to operate the drive mechanism 801 to extend or retract the leg assemblies 300, 400 in a direction substantially perpendicular to the longitudinal axis to set a height of the frame assembly 200 in the elevated position.

The leg assemblies 300, 400 are either gas spring assisted or motor assisted to enable their telescopic movement. The leg assembly 300 includes a first leg member 310 and a second leg member 320. One of the first leg member 310 and the second leg member 320 is constructed and arranged to be received by and extending in and out of other of the first leg member 310 and the second leg member 320 to facilitate longitudinal telescopic movement between the first leg member 310 and the second leg member 320.

Similarly, the leg assembly 400 includes a first leg member 410 and a second leg member 420. One of the first leg member 410 and the second leg member 420 is constructed and arranged to be received by and extending in and out of other of the first leg member 410 and the second leg member 420 to facilitate longitudinal telescopic movement between the first leg member 410 and the second leg member 420.

Each of the leg members 310, 320, 410 and 420 is generally hollow and includes the same cross-sectional configuration. In one embodiment, each of the second leg members 320 and 420 may include a plurality of leg segments, where one of leg segments is constructed and arranged to be received by and extending in and out of other of the leg segments to facilitate longitudinal telescopic movement therebetween. The frame assembly 200 may have an actuator that is easily accessible to the user/operator of the variable height platform assembly 100. The actuator is configured to actuate a lock assembly to selectively lock the leg assemblies 300, 400 at one of a plurality of longitudinally extended or retracted positions.

Figure 3:
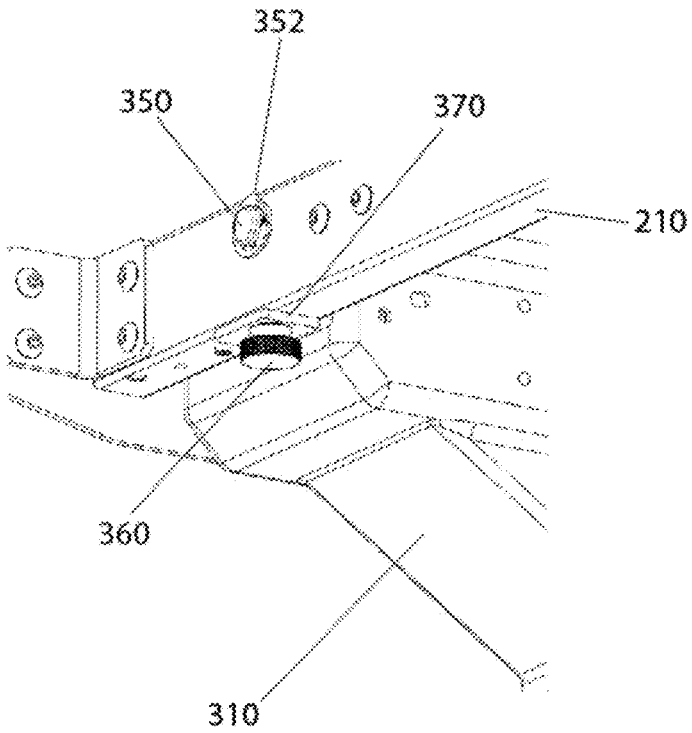
FIG. 3 shows a partial perspective view of a leg assembly of the variable height platform system in accordance with an embodiment of the present patent application.

Referring to FIGS. 3 and 4, the telescoping leg member 310 is pivotally or hingedly connected to the right frame portion 210 at the end portion 214 by a hinge pin or member 350 so as to facilitate the movement of the leg member 310 between its deployed position and its storage position. The hinge member 350 is generally received by axially aligned openings formed in leg assembly housing 312 (see FIGS. 8-12) of the leg member 310 and the right frame portion 210 and is then retained by a retainer clip 352. In one embodiment, the leg assembly 300 may include a retaining knurl screw 360 and a retaining bracket 370 that are configured to retain the leg assembly in its open position. The retaining knurl screw 360 and the retaining bracket 370 are configured to retain the leg assembly in its open position and provide an alternative to the latch mechanism disclosed in FIGS. 13-15. The leg assembly 400 include similar members/components, and has similar configuration and operation as that of the leg assembly 300 and, therefore, the configuration and operation of the leg assembly 400 will not be described in detail here.

Figure 12:
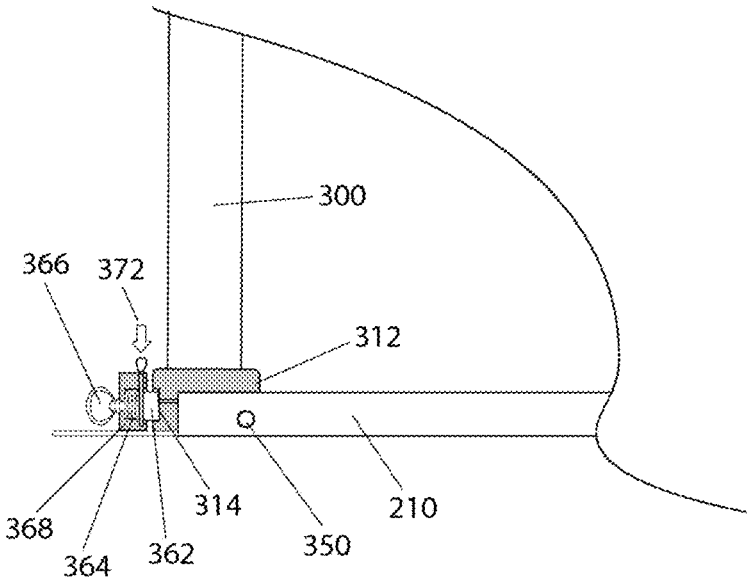
FIG. 12 shows a front view of the variable height platform system with the leg assembly unfolded and open and is in the locked position in accordance with an embodiment of the present patent application.
Figure 13:
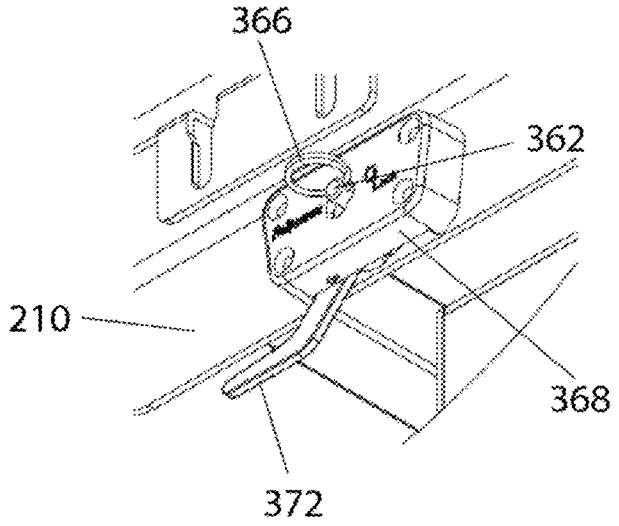
FIG. 13 shows a perspective view of the lock/latch assembly of the variable height platform system in accordance with an embodiment of the present patent application.
Figure 14:
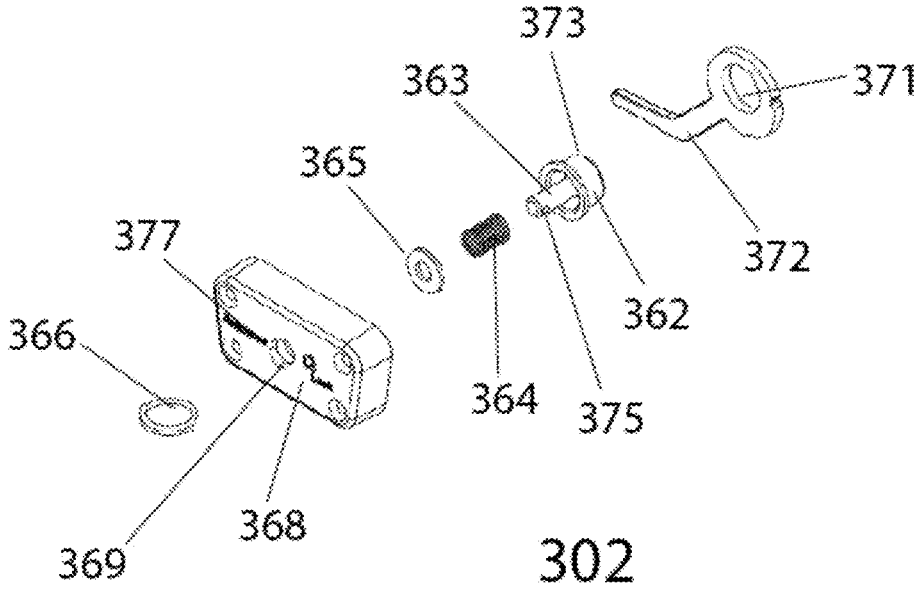
FIG. 14 shows an exploded view of the lock/latch assembly of the variable height platform system in accordance with an embodiment of the present patent application.
Figure 15:
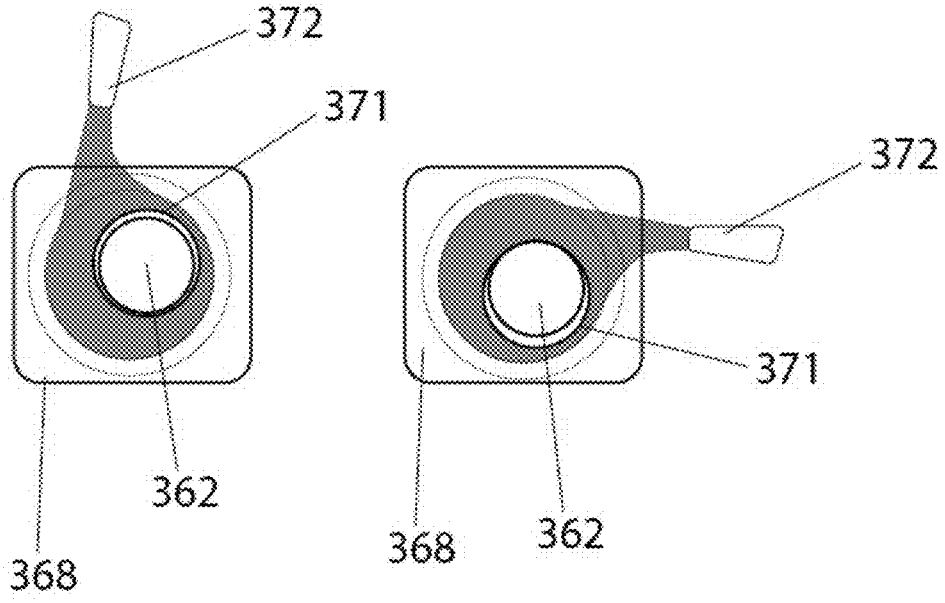
FIG. 15 shows front views of the lock/latch assembly of the variable height platform system in accordance with an embodiment of the present patent application.

Referring to FIGS. 13-15, the variable height platform system 100 includes a latch 302 that is configured to be biased into a lock position wherein it releasably engages with a lock engagement portion 314 (FIGS. 8-12) of an associated leg assembly 300 when that leg assembly 300 is its deployed position. The variable height platform system 100 also includes another latch for the leg assembly 400 when that leg assembly 400 is its deployed position. The structure, configuration and operation of both these latches are the same and, therefore, the structure, configuration and operation of only latch 302 will be described herein detail. Also, in FIGS. 8-17, the latch 302 is disposed on the frame assembly 200 and the corresponding latch engagement portion 314 is disposed on the leg assembly 300. In another embodiment, the latch may be disposed on the leg assembly and the corresponding latch engagement portion may be disposed on the frame assembly.

The latch 302 includes a housing 368, a latch pin 362, a lock lever 372, a compression spring 364, a latch release ring 366 and a spacer/washer 365. The lock lever 372 has off-center eccentric construction. In one embodiment, portion 210 of the frame assembly 200 may form part of the latch housing 368.

As will be clear from the discussions below, the latch 302 is configured to first snap into place by the engagement between the latch pin 362 and the latch engagement portion 314 when the leg assembly 300 moved from its storage position to its deployed position. The latch 302 then is configured to tighten by moving its eccentric lock level 372 to closed position to further secure the engagement between the latch pin 362 and the latch engagement portion 314.

As shown in FIG. 14, an (off-centered) opening 371 of the lock lever 372 is configured to receive and securely engage (e.g., press-fit or friction fit) with portion 373 of the latch pin 362 to assemble the lock lever 372 and the latch pin 362 together. The compression spring 364 and the spacer/washer 365 are assembled onto a shaft portion 363 of the latch pin 362. The shaft portion 363 of the latch pin 362 (with the compression spring 364 and the spacer/washer 365 assembled thereon) is received by and protrudes through an opening 369 of the housing 368 such that opening 375 on the shaft portion 363 of the latch pin 362 protrudes past surface 377 of the housing 368. The latch 302, thus assembled, is then retained together by the latch release ring 366.

The latch pin 362 is in the engaged and locked position by way of the lock lever 372 due to its off-center eccentric construction. The lock lever 372 is configured by way of lock lever guide opening 371 to exert a tightening force by pressing the latch pin 362 in a downward position within notch 314. This configuration ensures the leg assembly 300 is securely locked in the open position and to ensure stability of the leg assembly 300 and the frame assembly 200 in the open and engaged position. FIG. 15 shows that latch 302 in its unlatched position (on the left) and in its latched position (on the right).

Figure 8:
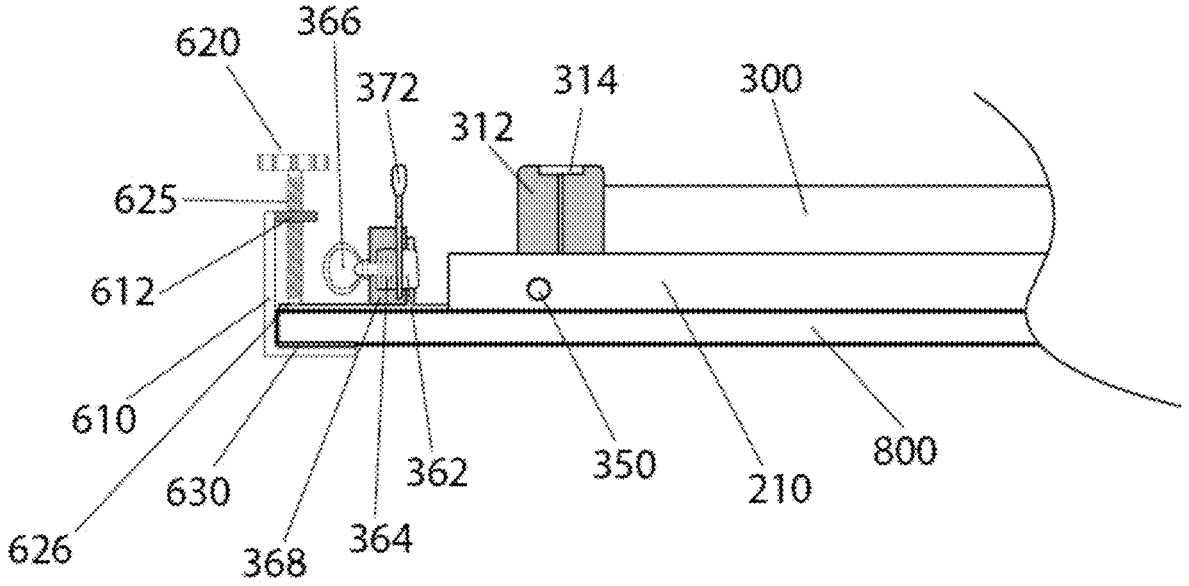
FIG. 8 shows a front view of the variable height platform system in a shipping or storage mode in accordance with an embodiment of the present patent application.

The operation of the latch 300 is described in detail in FIGS. 8-12. For example, FIG. 8 shows an exemplary illustration of the variable height platform system 100 in a shipping mode or a storage mode. The leg lock lever 372 is in its open, unlocked position with the latch pin 362 by way of compression spring 364 is encased within the latch housing 368 and retained by the latch release ring 366. The latch pin 362 is in the non-engaged position (i.e., latch pin 362 is not engaged with the lock engagement portion/notch 314 in the leg assembly housing 312) since the leg assembly 300 is in the closed, shipping or storage position.

Figure 11:
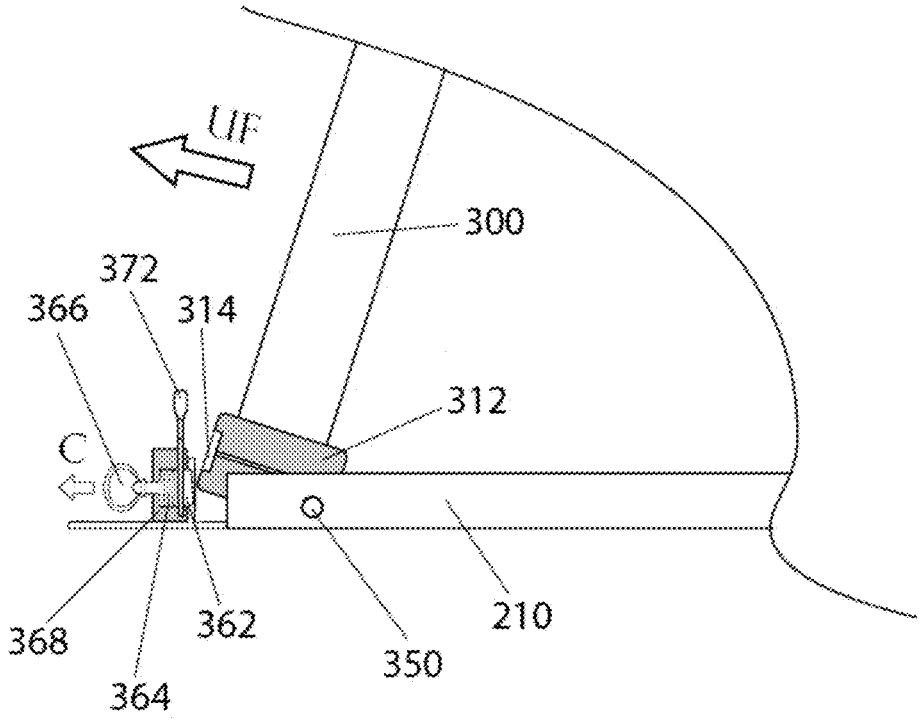
FIG. 11 shows a front view of the variable height platform system with the leg assembly as its being unfolded and initially engaging with a lock/latch assembly in accordance with an embodiment of the present patent application.

FIG. 11 shows an exemplary illustration of the variable height platform system 100 as the leg assembly 300 is being unfolded (in the direction of the arrow "UF") and as the leg assembly 300 initially engages with the latch 300. The leg lock lever 372 is in the open, unlocked position with the latch pin 362 initially engaging with notch 314 in the leg assembly housing 312 by way of the compression spring 364 actively compressing allowing the latch pin 362 (encased within the latch housing 368 and retained by the latch release ring 366) to move laterally (in the direction of the arrow "C") allowing the leg assembly housing 312 to displace the latch pin 362 until the latch pin 362 eventually engages with the lock engagement portion/notch 314 of the leg assembly housing 312.

Figure 9:
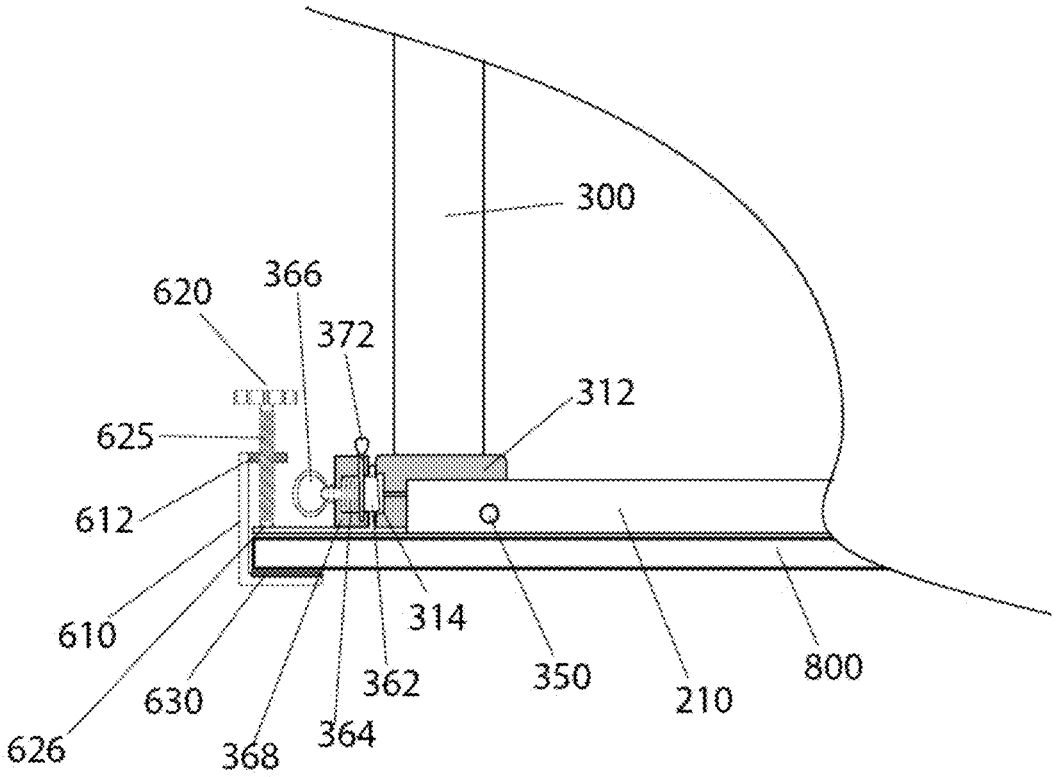
FIG. 9 shows a front view of the variable height platform system with its leg assembly in an open position in accordance with an embodiment of the present patent application.

FIGS. 9 and 12 show exemplary illustrations of the variable height platform system 100 with the leg assembly 300 in an unfolded, open, or deployed position and also in the locked position. FIG. 9 shows the frame assembly 200 with the tabletop 800 attached thereto, while FIG. 12 shows the frame assembly 200 without the tabletop 800 attached thereto. The leg lock lever 372 is in the closed, locked position with the latch pin 362 engaged with the lock engagement portion/notch 314 in the leg assembly housing 312 by way of the compression spring 364 (encased within the latch housing 368 and retained by the latch release ring 366). The latch pin 362 is shown in the engaged and locked position by way of the lock lever 372 due to its off-center eccentric construction. The lock lever 372 exerts a tightening force by pressing the latch pin 362 into a position within the lock engagement portion/notch 314 in the leg assembly housing 312 to ensure the leg assembly 300 is securely locked in the open/deployed position and to ensure stability of the leg assembly 300 and the frame assembly 200 in the open and engaged position.

Figure 10:
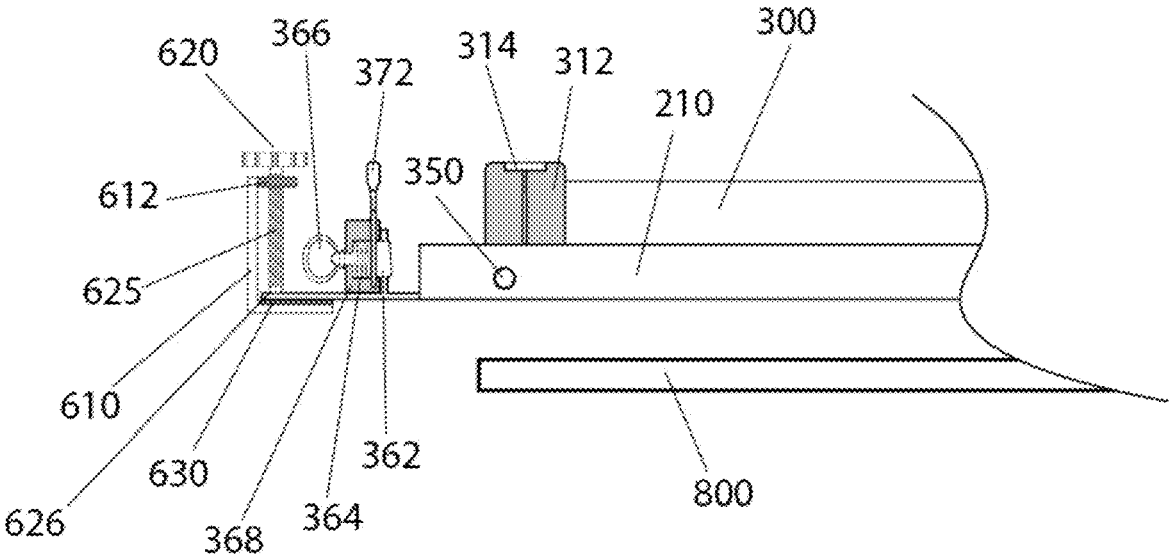
FIG. 10 shows a front view of the variable height platform system in a shipping or storage mode, where the frame assembly of the variable height platform is shipped or purchased without the tabletop connected thereto, in accordance with an embodiment of the present patent application.

FIG. 10 shows an exemplary illustration of the variable height platform system 100 in the shipping or storage mode. This is an alternative embodiment where the frame assembly 200 is shipped to the end user or purchased by the end user without the tabletop 800. As illustrated in FIG. 10, the tabletop 800 is not initially clamped to the frame assembly 200 as the tabletop 800 is to be shipped separately or alternately, an existing variable height platform system can be utilized.

Referring to FIGS. 2, 4, 5, 8-10 and 18, the variable height platform system 100 includes left and right clamp assemblies or connectors 500 and 600 that are configured (e.g., to be tightened) to hold the tabletop 800 in place. The clamp assemblies 500, 600 are disposed on (or assembled onto) two opposing sides of the frame assembly 200. The structure, configuration and operation of both these clamp assemblies or connectors are the same and, therefore, the structure, configuration and operation of only right clamp assembly or connector 600 will be described herein detail.

The left and right clamp assemblies or connectors 500 and 600 are also configured to accommodate different tops having varying thicknesses. In one embodiment, the clamp assemblies 500, 600 are configured to receive the tabletops 800 having a thickness in the range between 0.25 inches and 1.5 inches. In another embodiment, the clamp assemblies 500, 600 are configured to receive the tabletops 800 having a thickness in the range between 1.5 inches and 2.75 inches. In one embodiment, a first set of clamp assemblies connected to the frame assembly 200 may be used to accommodate the tabletops range between 0.25 inches and 1.5 inches and a second set of clamp assemblies connected to the frame assembly 200 may be used to be accommodate the tabletops range between 1.5 inches and 2.75 inches. In one embodiment, metal tabletops with rubber tops and/or overly thick tabletops (e.g., 3.5 inches or higher) may use edge mounting for their capacitive sensor array arrangement 701.

The variable height platform system 100 with the clamp assemblies 500, 600 enables an office or a business to easily update/replace the tabletops 800 for one or more of the frame assemblies 200 in the office/business to achieve unified office décor and complete cohesive office décor. Also, the system 100 with the clamp assemblies 500, 600 enables the office/business/company to easily use differing or customized tabletops 800 for one or more of their frame assemblies 200 as needed. For example, the office/business/company/user may easily customize their system 100 by simply assembling a desktop or tabletop of choice, even a glass or custom design tabletop to create a unique sit stand desk or table (i.e., with no tools and within a few minutes).

Figure 5:
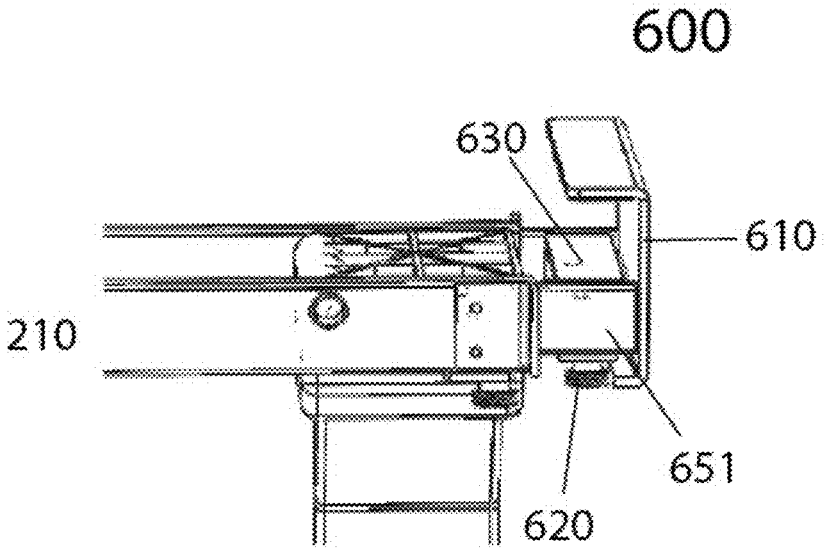
FIG. 5 shows a perspective view of a clamping assembly of the variable height platform system in accordance with an embodiment of the present patent application.

As shown in FIGS. 5 and 8, the right clamp assembly or connector 600 includes right clamp 610, adjustment knob receiving structure 612, clamp tension adjustment knob 620, threaded portion 625, and support (e.g., rubber) pad 630. The right clamp 610 and the adjustment knob receiving structure 612 are integrally formed. The rubber pad 630 is formed on an inner surface portion (that comes into contact with a surface of the tabletop 800 being clamped or with a surface of the frame assembly 200) of the right clamp 610. The rubber pad 630 is configured to protect the tabletop being clamped. The clamp tension adjustment knob 620 and the threaded portion 625 are integrally formed. The screw or threaded portion 625 includes threads machined on its outer surface and extending along its length. The adjustment knob receiving structure 612 is constructed and arranged to be threaded onto the screw or threaded portion 625 and includes complimentary threads machined on its inner surface. The clamp tension adjustment knob 620 is optionally knurled for easy finger loosening and tightening. The right frame portion 210 of the frame assembly 200 includes right frame insert 651 (as shown in FIG. 5) for the right clamp assembly 600.

The right clamp 610 with the rubber pad 630 can be tightened to hold the tabletop 800 (not shown) in place by the rotating adjustment knob 620 in a clockwise direction. The tabletop 800 can be detached from the frame assembly 200 by the rotating adjustment knob 620 in a counter-clockwise direction (and loosening the right clamp 610).

The clamp assembly 600 may be releasably attached to the frame assembly 200. The clamp assembly 600 may be guided by the frame assembly 200. The clamp assembly 600 may optionally include a threaded weldment attachment 626 that is configured to attach the clamp assembly 600 to the frame assembly 200.

Figure 18:
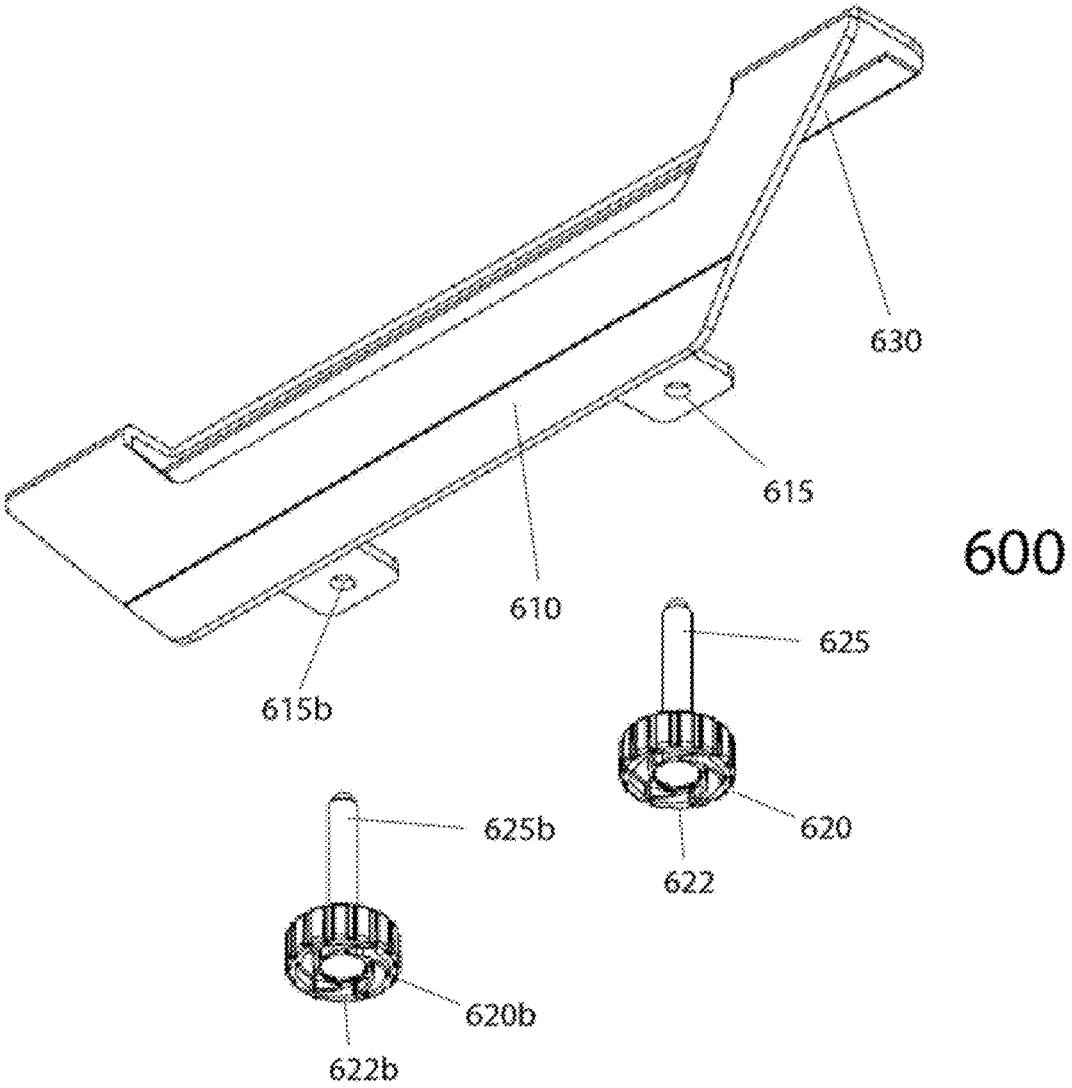
FIG. 18 shows a semi-exploded prospective view of the clamp/connector assembly of the variable height platform system in accordance with an embodiment of the present patent application.

FIG. 18 shows a semi-exploded view of one of two clamping assemblies 600 in accordance with another embodiment of the present patent application. The right clamp assembly 600 includes the right clamp 610, the adjustment knob 620 with a clutch mechanism 622, an adjustment knob 620*b* with a clutch mechanism 622*b*, and adjustment knob receiving structures 615, 615*b* interacting with threaded portions 625, 625*b*. The clutch mechanisms 622 and 622*b* of the right clamp assembly 600 are configured to keep the respective adjustment knobs 620 and 620*b* from being over tightened. The right clamp 610 with the rubber pad 630 can be tightened to hold the tabletop 800 (not shown) in place by rotating the adjustment knobs 620, 620*b* in a clockwise direction.

Figure 17:
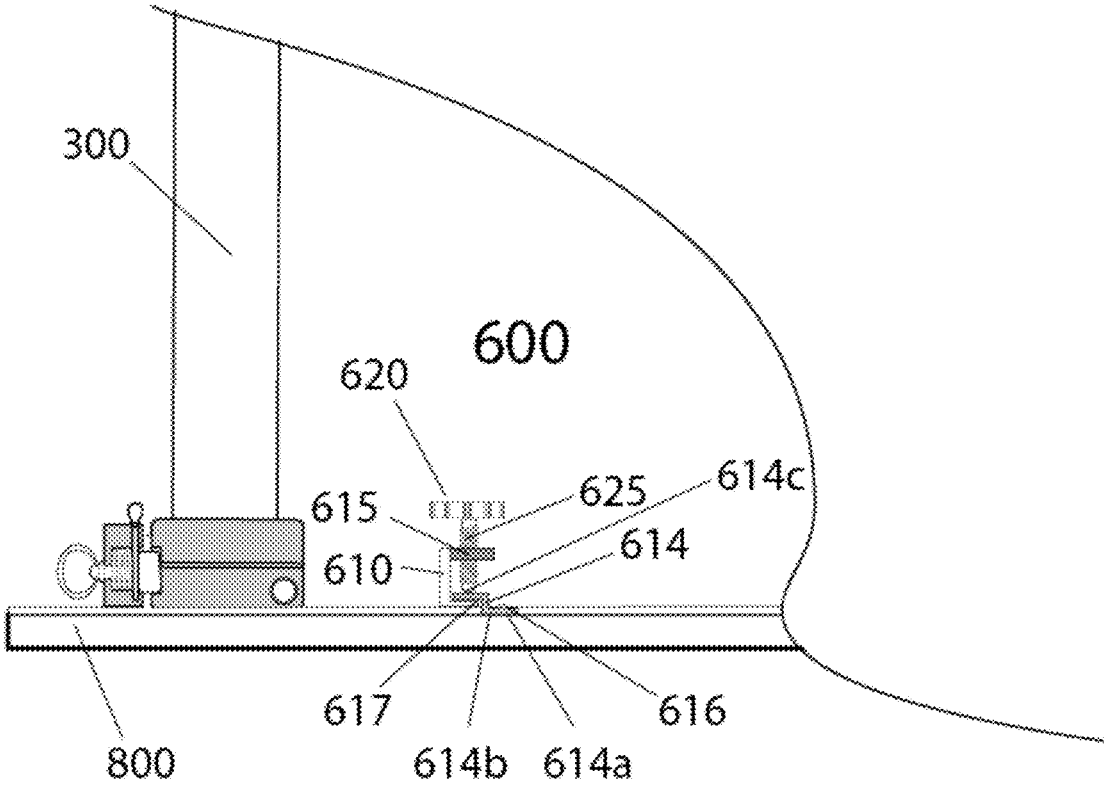
FIG. 17 a front view of the variable height platform system with the tabletop being retained in place by an alternative (hidden) attachment method in accordance with an embodiment of the present patent application.

FIG. 17 an exemplary illustration of the variable height platform assembly 100 with the tabletop 800 being retained in place by an alternative (e.g., hidden) attachment method. The clamp assembly 600 includes an alternative clamp component 610 interacting with a tabletop retaining bracket 614 (i.e., mounted to the underside of the tabletop 800) by way of the adjustment knob 620 and the corresponding receiving element 615 interacting with the threaded portion 625. The tabletop retaining bracket 614 may be mounted to the underside of the tabletop 800 using attachment mechanism (e.g., screws, fasteners, etc.). The tabletop retaining bracket 614 may have a Z-shaped configuration. A portion 614*a* of the tabletop retaining bracket 614 may be attached to the underside of the tabletop 800 using a screw 616. A portion 614*b* of the tabletop retaining bracket 614 may be received in an opening 617 in the frame assembly 200. A portion 614*c* of the tabletop retaining bracket 614 is received by the clamp assembly 600 and is in engagement with the protection pad 630 of the clamp assembly 600. Once the tabletop 800 with the assembled retaining bracket 614 is mated with the alternative clamp component 610, the clamp assembly 600 can be tightened to hold the tabletop 800 in place by rotating the adjustment knob 620 in a clockwise direction.

Figure 22:
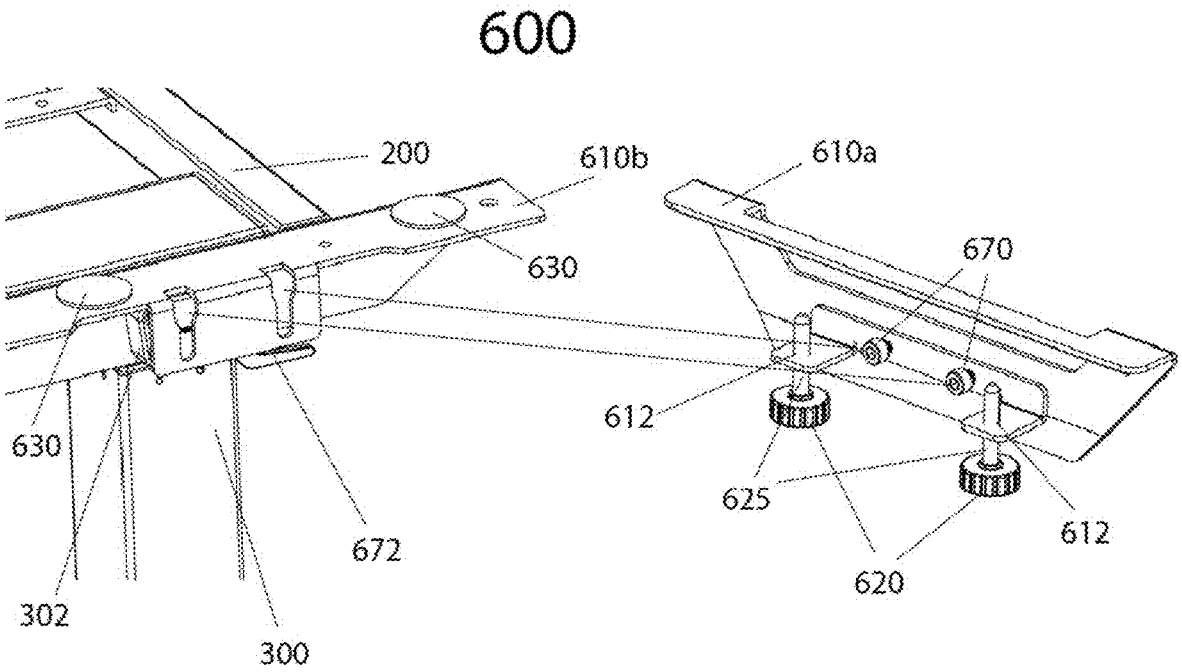
FIG. 22 shows two prospective views of the clamp/connector assembly of the variable height platform system in accordance with an embodiment of the present patent application.

Referring to FIG. 22, the clamp assembly 600 may include attachment members 670 (e.g., shoulder bolts) that are configured to be inserted into attachment member engagement portion 672 (e.g., key hold like feature) on the frame assembly 200 to retain the clamp assembly 600 to the frame assembly 600 (e.g., even in the absence of the tabletop 800). In the FIG. 22, the clamp members 610*a* and 610*b* together form the right clamp 610.

The operation of the right clamp assembly 600 is described in detail in FIGS. 8-9, 10, and 16. For example, FIG. 10 shows an exemplary illustration of the variable height platform system 100 in which the tabletop 800 is separate and is not connected to the frame assembly 200. FIG. 10 also shows the right clamp assembly 600 is an initial, unclamped position. From this configuration, the right clamp 610 is moved to an open or receiving position to receive the tabletop 800 by rotating the adjustment knob 620 in a counter-clockwise direction.

Figure 16:
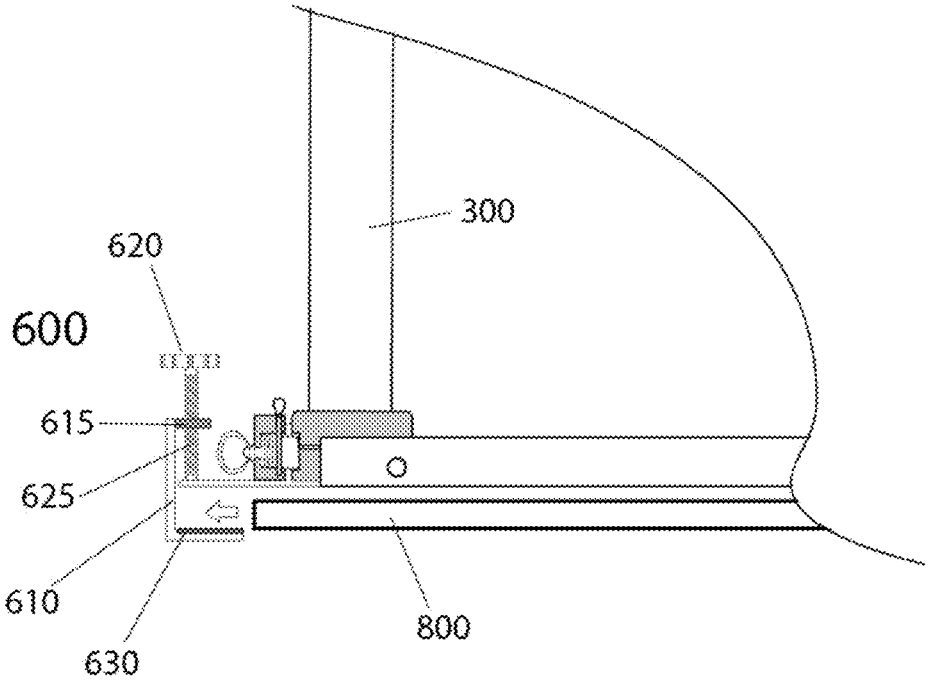
FIG. 16 shows a front view of the variable height platform system with the tabletop being attached to the frame assembly in accordance with an embodiment of the present patent application.

FIG. 16 shows an exemplary illustration of the variable height platform system 100 in which the tabletop 800 is being inserted into the right clamp 610 (so as to connect the tabletop 800 to the frame assembly 200) and the right clamp 600 is in the open position. Once the tabletop 800 is inserted into the right clamp assembly 600, the adjustment knob 620 is rotated in a clockwise direction to tighten the right clamp 610 with the rubber pad 630 and to hold the tabletop 800 in place. FIGS. 8 and 9 show the right clamp assembly 600 is the clamped position holding the tabletop 800 in place. When the tabletop 800 is received by the right clamp assembly 600, the tabletop 800 is supported by the rubber pad 630 of the right clamp 610 on one side thereof and is supported by the right frame clamp insert 651 of the right frame portion 210 on the other side thereof.

The variable height platform system 100 may include one frame assembly 200 and a plurality of different tabletops 800. The left and right clamp assemblies or connectors 500 and 600 that are configured to detachably secure one of the plurality of different tabletops 800 to the frame assembly 200. The clamp assemblies 500, 600 allow for a wide variety of desktops or tabletops to be clamped onto the frame assembly 200 by simply loosening their clamp tension adjustment knob (e.g., 620). The tabletop of choice is placed onto the frame assembly 200 (the frame assembly 200 and the clamp assemblies 500, 600 may slidably adjusted to accommodate a wide variety of sizes of desktops or tabletops), and the clamp assemblies 500, 600 are fitted onto the opposing sides of the tabletop entrapping the tabletop within the clamp assemblies 500, 600. The clamp assemblies 500, 600 are simply tightened to finalize the assembly of a desktop or tabletop of choice, even a glass or custom top or an existing desktop onto the frame assembly 200 to create a unique sit stand desk or table with no tools and within a few minutes.

The variable height platform system 100 also includes right base member 330 and left base member 430 that are configured to provide stability to the variable height platform system 100. The base members 330 and 430 are configured to be connected to end portions 322 and 422 of the respective leg assemblies 300 and 400. The base members 330 and 430 may be extendible, as needed, in a direction perpendicular to the longitudinal axis L-L to provide stability to the variable height platform system 100 when the variable height platform system 100 is supporting various configurations (size and/or shape) of the tabletops 800. The configuration of the base members 330 and 430 is not limiting, and any design/configuration of the base members 330 and 430 to stably support the variable height platform system 100 on the surface, floor or ground may be used.

The base members 330 and 430 may also include adjustable members (or leveling members) 340 and 440, respectively positioned on their undersides that are configured to stabilize the variable height platform system 100, for example, on an uneven surface, floor or ground. The adjustable members 340 and 440 may each include a threaded rod portion that is adjustably received within an associated internally threaded opening on the undersides of the respective base members 330 and 430. The adjustable members 340 and 440 may each include a support platform that is attached to the other end of the threaded rod portion and is configured to bear against the surface, floor or ground. The adjustable members 340 and 440 may include a ball joint or similar mechanism to stabilize the variable height platform system 100, for example, on an uneven surface, floor or ground. The adjustable members 340 and 440 may include other mechanisms to stabilize/level the variable height platform system 100, for example, on an uneven surface, floor or ground.

The frame assembly 200 is configured to accommodate a repositionable control panel mount or control panel/user interface assembly 700. The control panel/user interface assembly 700 allows for the entire controller 123 to be pre-assembled onto the frame assembly 200 at the factory as to minimize the time the customer spends to go from out of the box to up and running even when purchasing the clamping frame system without the pre-assembled top.

On the electronically operated motorized leg versions, the controller 123 utilizes a unique arrangement whereas the control panel/user interface assembly 700 (e.g., protruding actuator) is used vs. the standard tactile buttons.

The control panel/user interface assembly 700 has an actuator with upper surface 710 and lower surface 711 facilitating actuation by way of touching of the upper surface 710 or lower surface 711 thereby actuating the telescoping legs to operably raise or lower the frame assembly 200 accordingly. The control panel/user interface assembly 700 has two opposing capacitive sensor elements that allow the operator/user to simple touch lower side 711 of the control panel/user interface assembly 700 to initiate the motorized telescoping leg assemblies 300, 400 to extend or raise the platform/frame assembly 200 upwards. In the opposing mode, touching the upper side 710 of the control panel/user interface assembly 700 retracts the telescoping leg assemblies 300, 400 or move the platform/frame assembly 200 downwards.

Once a lower and an upper height is chosen, each operator can able to store their given preferable positions. As they use the variable height platform system 100 over a given amount of time, the upper and lower limits will continue to adjust ensuring the users most recent preferences are stored into the memory. The capacitive actuated controller acts as one sensor array, optionally an additional sensor array may be added by way of an antennae (750 in FIG. 6) extending out from the controller 123. The multiple sensor arrays then can detect transitional movement from one area to the next accurately and precisely. This sensing feature may also aid in notifying the operator when they have been either sitting or standing too long. The controller 123 may be configured to notify the user, via the user interface 720 or by visual, audio signal or any other communications means when the operator has been either sitting or standing too long. When movement across the sensor array has been detected, a timer on the controller would initiate so as to more accurately determine when the controller should let the operator/user be aware to change their state (e.g., to stand up, walk around or to sit down). The frequency and the manner the controller 123 signals the operator/user would be selected by the operator by way of selective inputs on the control panel/user interface assembly 700. The controller 123 would accumulate the data over time and the operator could access the data by way of a display on the user interface, or mobile application or optionally the data could be uploaded to the cloud as to be accessible by any device the operator chooses.

Figure 6:
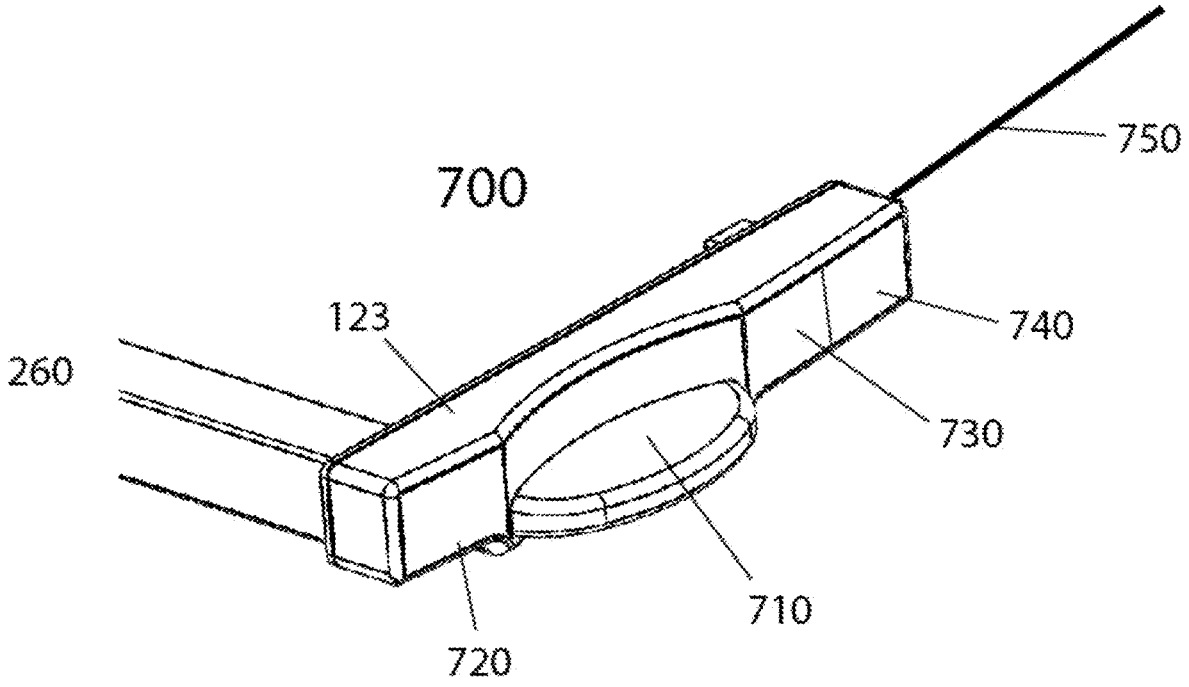
FIG. 6 shows a perspective view of a control panel/user interface of the variable height platform system in accordance with an embodiment of the present patent application.
Figure 7:
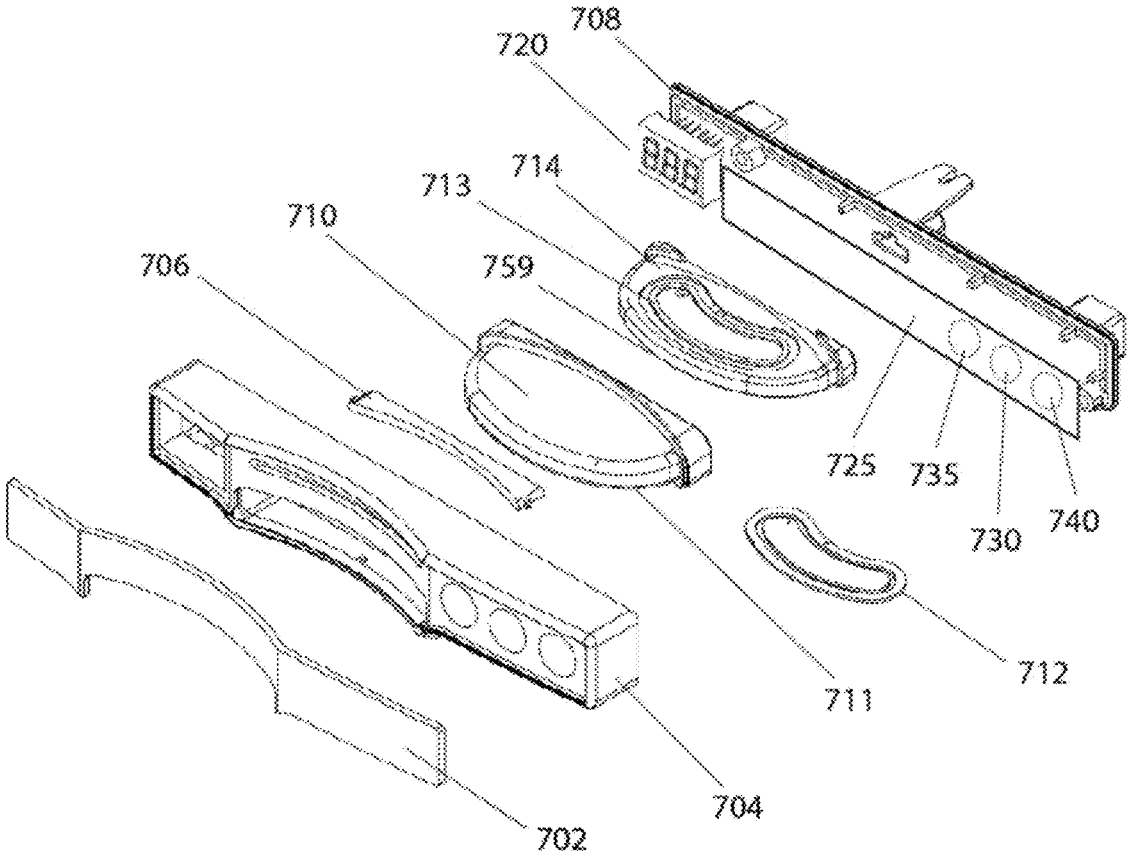
FIG. 7 shows an exploded view of the control panel/user interface assembly in accordance with an embodiment of the present patent application.

In one embodiment, as shown in FIGS. 6 and 7, the variable height platform system 100 includes the control panel/user interface assembly 700 that is configured to remotely (i.e., remotely tethered with optionally wireless control means, Bluetooth, Wifi, NFC as to be activated by a mobile phone, tablet or computer application) activate the lift assisted supportive leg assemblies 300, 400.

The control panel/user interface assembly 700 includes lens 702, a front housing 704, a capacitive touch actuator 710, an optional graphical display 720, an optional user selectable memory 730, an optional coaching mode 740, and an capacitive sensor antenna array 750. The lens 702 is assembled onto the front housing 704. The front housing 704 accommodates the capacitive touch actuator 710. The user interface 720 may be a display such as a graphical display. The display may be a touch screen display or a liquid crystal display (LCD) display.

The capacitive touch actuator 710 is configured to protrude outwardly from the frame assembly 200 so as to be easily accessible to the user. The control panel/user interface assembly 700 may include a Smart Touch feature that provides a touch activated control panel or a capacitive touch panel. A top/upper surface 710 of the capacitive touch actuator 710, when touched by the end user, is configured to retract the telescopic leg assemblies 300, 400 and a bottom/lower surface 711 of the capacitive touch actuator 710, when touched by the end user, is configured to extend the telescopic leg assemblies 300, 400.

The capacitive touch actuator 710 with the upper surface 710 and the lower surface 711 and corresponding inner support 714 allowing capacitance sensing arrays—upper cap sensor array 713 and lower cap sensor array 712 to be assembled within the capacitive touch actuator 710 in a manner as to facilitate the touching of the upper surface 710 or the lower surface 711 to actuate the telescoping leg assemblies 300, 400 to operably raise or lower the frame assembly 200 accordingly.

The control panel/user interface assembly 700 optionally includes a light pipe 706 that facilitates the transmission of light from a Printed Circuit Board (PCB) 725 to the surface of lens 702. The graphical display 720 may be assembled onto the PCB 725 to communicate user settings as well the operational status of the variable height platform system 100 (e.g., height of the tabletop surface, user memory settings, etc.).

The control panel/user interface assembly 700 includes operational buttons 730, 740 that are selectively programmed as to activate and toggle through optional user selectable memory settings, optional coaching mode settings, etc. The coaching mode settings turns on the capacitively actuated multi sensor array, which communicates with the controller 123 to process the signal data and function per the user selectable function levels.

Capacitive sensor array cap sensor 759 (as shown in FIG. 23) is configured to sense the user's presence. Capacitive sensor array cap sensor 759 (as shown in FIG. 23) is also configured to work in combination with the other cap sensor arrays so as to sense the operator's presence, movement and/or position to safely actuate the leg assemblies 300, 400 to move the frame assembly 200 to a predetermined memorized position without the operator/user having to maintain physical contact with the corresponding actuator once it is triggered.

The sensor array may generally include a transmitter for transmitting signals produced by a signal generator of the sensor array and a receiver for receiving back those same signals after they interacted with an environment. As such, the sensor array acts as a proximity sensor device configured to detect the presence of any object (person or other movable living things) within the predetermined area proximate the variable height platform system.

The coaching mode 740 turns on the capacitive actuated multi sensor array and communicates with the controller 123 to process the signal data and function per the user selected function level.

The capacitive sensor antenna array 750 is configured to plug onto one end of the capacitive touch actuator 710 so as to be replaced easily. The capacitive sensor antenna array 750 can be adhesive tape mounted to the underside of the desk/table or inserted into a pre-grooved detail on the underside of the desk/table, or inserted into the edge molding of the desk/table.

FIG. 19 shows a capacitive based sensor array arrangement 701 of the variable height platform system 100. The control panel/user interface assembly 700 may optionally have capacitive based sensors. Some of capacitive based sensors are configured to act as control actuators that, in turn, allow the panel/user interface assembly 700 to function as a presence detector as well. Additional presence detectors or sensors that are capacitive based may be added to the variable height platform system 100 to extend the presence detection features.

The capacitive based sensor array arrangement 701 of the variable height platform system 100 incorporates both proximity sensing functionality and activity sensing functionality in one self-contained sensor module. This single capacitive based sensor array arrangement 701 is configured to sense activity on the tabletop 800 and adjacent to the tabletop 800.

The capacitive based sensor array arrangement 701 of the variable height platform system 100 is configured to enable field sensing both across the tabletop 800 and also through (i.e., the material of) the tabletop 800.

The capacitive based sensor array arrangement 701 of the variable height platform system 100 is configured to both detect actual movement across the sensor thresholds (i.e., interaction with the table) and to detect presence (proximity to the table) allowing the controller 123 to react if a predetermined threshold of movement and presence on and above the surface has been reached. The capacitive based sensor array arrangement 701 of the variable height platform system 100 is also configured to detect presence both on and adjacent to the tabletop 800. That is, the single capacitive based sensor array arrangement 701 of the variable height platform system 100 is configured to do both actions (i.e., proximity AND movement) and detect adjacent proximity and direct proximity and safety. The single capacitive based sensor array arrangement 701 of the variable height platform system 100 is able to unifying the sensors so as to multi-task them and to able to modularly extend the range/zone.

The capacitive based sensor array arrangement 701 of the variable height platform system 100 is configured to form a three dimensional sensing arrangement. That is, the capacitive based sensor array arrangement 701 of the variable height platform system 100 is configured to sense along a front of the tabletop 800 and lateral edges of the tabletop 800. The capacitive based sensor array arrangement 701 of the variable height platform system 100 is configured to sense through (i.e., the thickness) of the tabletop 800.

The sensors 750, 753, 755, 757 of the capacitive based sensor array arrangement 701 of the variable height platform system 100 are coupled to the control panel/user interface assembly 700 by using connectors 751, 752, 754, 756, and 758, respectively. The sensors 750, 753, 755, and 757 have input (e.g., lead wires) going to the controller 123.

This array configuration creates exemplary presence sensing zone 750*b* (corresponding to sensor 750), sensing zone 753*b* (corresponding to sensor 753), sensing zone 755*b* (corresponding to sensor 755), and sensing zone 757*b* (corresponding to sensor 757). These sensing zones 750*b*, 753*b*, 755*b* and 757*b* are configured to sense presence of the user around the variable height platform system 100. The exemplary presence sensing zones may extend along at least a front (edge) and a lateral edge of the tabletop 800. The exemplary presence sensing zones may optionally extend along the back of the tabletop 800. These sensing zones 750*b*, 753*b*, 755*b* and 757*b* are also configured to sense presence of the user through the tabletop 800 that is supported on the frame assembly 200 of the variable height platform system. These sensing zones 750*b*, 753*b*, 755*b* and 757*b* are also configured to sense presence of the user through other visually blocking materials or solid materials. Each of these sensing zones 750*b*, 753*b*, 755*b* and 757*b* are configured to individually detectable. The control panel/user interface assembly 700 is configured to house the controller 123 such as an integrated controller (IC). The integrated controller 123 is configured to process and react according to predetermined actions once a multitude of triggering levels have been sensed by the sensor element or elements.

The exemplary presence sensing zones 753*b* or 757*b* are configured to detect the presence of a hand or a finger of the user on or near a lateral edge of the desktop 800 so to prevent incidental pinching of the hand or fingers against another surface or element, i.e., by not allowing the controller 123 by way of the sensor signal processing IC to prevent activation of the height adjustment motors). The variable height platform system 100 may also include a safety switch that cuts power to the built-in power supply. Additional sensors or sensor elements may be coupled together to extend or shape the sensing zones. The coupling connectors 751, 752, 754, 756 and 758 may optionally have an onboard integrated circuit that is configured to help process and extend the sensing capabilities of the interconnected sensing array.

FIG. 20 shows another capacitive based sensor array arrangement of the variable height platform system 100. For example, when sensing the presence of the operator/user, the control panel/user interface assembly 700 allows the height adjustment feature to be activated by a single touch to reach a desired height vs. having to keep one's finger on the activation button. If the user leaves the sensing zone, the height adjustment feature would then deactivate as to prevent incidental issues with the table moving up and down with no one present. Additionally, the presence sensing would allow for a more accurate assessment of the operator's time spent in the sitting and standing positions allowing for more accurate accounting of actual usage within a given position against a given element of time.

In one embodiment, the system 100 is configured to automatically raise and lower itself after it has given a visual and or audio warning or indication it is about to move. In another embodiment, the system 100 is configured to sense that the operator/user is in such a position as to safely decide when to automatically raise or lower itself and to give the operator/user time to over-ride the automatic action. Optionally, the system 100 can be configured to only indicate by visual means (e.g., flashing LED) and audio means (e.g., speaker) when the user/operator is within visual and or audio indication range (e.g., within reach of the system 100) and safely placed (in front of the system 100 with hands on or above the working surface of the tabletop 800) as to allow the system 100 to move automatically only when the operator/user is present and fully aware. This allows not only for safe operation, but also is a means to ensure that the system 100 changing its state is observed by the operator/user. Alternatively, the system 100 may indicate to the operator/user when it is the proper time to change orientation (height) as to indicate to the operator/user they should change position allowing the operator/user to indicate back to the system 100 through motion, user input or auditory means that the operator/user accepts the suggestion and actuates the system 100 to change its state. In this method, the operator/user is in total control and would give the input signal to the system 100 as to allow it to change versus the system 100 automatically changing state.

In one embodiment, in a non-motorized version, the system 100 would function similarly; the system 100 could indicate to the operator/user when it is the proper time to change orientation (height) as to indicate to the operator/user that they should change position. The operator/user manually changing the state of the platform or tabletop 800 would be considered as an input means by the system 100 and the system 100 signals to the controller of the system 100 that the operator/user accepts the suggestion.

Small movements of the system 100 within the optimal standing or sitting height is advantageous to the operator/user since these small changes, even if not observed by the operator/user reduces the opportunity for exact repetitive movements to occur which can strain the body. This feature would operate on the motorized version by observing the preferred and confirmed upper (standing) and lower (sitting) positions for the platform—which have been placed into the system 100's memory. Within these preferred settings, the height of the system 100 would vary automatically and seemingly randomly within an acceptable range (e.g., two inches) by moving a quarter of an inch, then one inch, and then reversing itself one inch, and then quarter inch etc. This type of movement can be slowed as to make the operator/user unaware the system 100 is actually changing its state so as to not interfere with the operator's daily task yet still aid the operator as intended by this feature.

In another embodiment of this feature, the system 100 could vary the tabletop height frequency and range more aggressively as to encourage the operator/user to move themselves in larger ranges of movement (e.g., greater than two inches) and more frequently so as to purposely create a physical challenge for the more athletic operator/user. This type of purposeful movement would simulate a more advanced and challenging sets of movements that can exercise the body. These types of movements would give the operator/user the similar gains as a treadmill desk (i.e., desk that allows the operator to walk on the treadmill while working) without the danger, cost and the larger size and awkwardness associated with such devices. In the manually operated embodiment of this feature, the operator/user would be encouraged by the system 100 to manually move the desktop 800 more often so as to gain the benefits which come from the more challenging constant and greater ranges of movements associated with this feature.

The controller 123 of the variable height platform system 100 may be configured to receive the sensor inputs. The controller 123, based on the sensor inputs, may be also configured to control the operation of the variable height platform system 100. The controller 123 takes into consideration the received sensor readings when actuating the variable height platform system 100 to react, signal, communicate, and automatically respond to the received signals depending on the predetermined conditions programmed into the variable height platform system 100 and/or a virtual digital machine residing in "the cloud" or a remote server in communication with the variable height platform system 100. The controller 123 may include a control circuit. However, the controller may alternatively include any other type of suitable controller without deviating from the scope of the present patent application. For example, the controller may include a processor executing code; an integrated computer system running a program; analog or digital circuitry; etc.

The variable height platform system 100 also may include a memory device connected to, or integral with, the controller 123 for storing information related to the variable height platform system. The stored information, for example, may include predetermined threshold ranges, predetermined criteria, determined cycles, patterns and usage of the variable height platform system. The memory device may also be configured to store other settings or parameters of the variable height platform system 100. The controller 123 may store information within the memory device and may subsequently retrieve the stored information from the memory device. The memory device may include any suitable type of memory, such as, for example, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory), a Flash memory or any other suitable memory.

The capacitive sensor array arrangement 701 is mounted on the frame assembly 200 (and is disposed on the underside of the tabletop 800) and specifically points towards the operator/user. The capacitive sensor array arrangement 701 is operatively connected to the variable height platform 100. The capacitive sensor array arrangement 701 is configured to sense the position and movement of a user on, above and around the variable height platform system 100 for outputting data to determine how the user is positioned on, above and around the variable height platform system 100 in comparison to a predetermined target position. The processor 123 is configured to: receive the data from the sensor arrangement, compare the received data to a predetermined target position, and display an indication of the comparison to the user. The variable height platform system 100 also includes a display device with a processor. The sensor arrangement may include the sensors. For example, the processor is configured to compare the data against the user's activity preferences while taking into consideration the user's experience curve. This helps to ensure the variable height platform system 100 properly recommends when the user should change states/positions. These recommendations may be determined by the following, or any combination of the following: sensor readings/data, position of the variable height platform, how much active time the user has spent at certain (sitting/standing) positions as compared to the user's experience curve and their preference settings. In one embodiment, the sensors may also be used in the non-motorized version of the variable height platform system. For example, as the sensors do not use a lot of power, the sensor may be powered by a USB cable or a battery in the non-motorized or manual version of the variable height desktop workstation system.

Active movement sensors create a sensor array or arrangement that is configured to detect an operator's movement on, across and above the platform. Operator sensing active movement sensors are configured to create sensing/sensor zones (e.g., 750*b*, 753*b*, 757*b*, 755*b*) which can detect movement on, above and around the platform. These zones 750*b*, 753*b*, 757*b*, and 755*b* when overlapped have varied sensitivity and as a hand of the operator moves around and through these zones, varied signals levels are detected and transmitted to the controller. In one embodiment, the actions of keying on a keyboard, moving an input device such as a mouse, even writing on the surface of the platform are be detected and registered as active movement and engagement with the variable height platform system. The detection of movement (and not just the presence of a person/an operator near the variable height platform system) ensures that the variable height platform system only credits active system vs. a resting state or a person/an operator being simply near the variable height platform system and not engaging it as intended. This arrangement of sensors allows for a higher resolution and recognition of certain intentional movements that may be used to signal and activate a predetermined action. For example, both hands moving forward over the surface signals the controller to make the variable height platform system rise and alternatively, both hands moving backwards over the surface of the platform, signals the controller to make the variable height platform system lower itself. This arrangement in such a device is also able to detect the presence of certain products that have been given key resistive or capacitance values. For example, a keyboard wrist rest would give out a passive resistive or capacitive signal of a specific value. When the keyboard wrist rest is placed upon the platform, the active movement sensors are configured to detect the specific resistive or capacitive value and signal the presence of the wrist rest to the device's controller. It is well known that using ergonomic accessories such as a wrist rest (not shown) allows the operator to do a given task like keyboarding in an ergonomically healthier way and the controller would then allow the person to get so called ergonomic credit for having and using such a device. Starting with a higher ergonomic value would allow the person/operator to work at a specific task longer and the controller detecting the presence of the wrist rest by way of the active movement sensors would then alter the timing sequences accordingly. The more specialized ergonomic devices used by the operator, the longer they are allowed to work in a given state as compared to the time when not using such a device. This present application uniquely senses and recognizes these configurations and devices as to react properly and uniquely through the controller and a sequence of predetermined actions then may be activated by the controller.

Through observation and research, the inventors of the present patent application have recognized the need for a variable height platform system, which senses the user's active engagement with the system's tabletop in such a way as to aid or coach them in the process of integrating the sit/stand more readily into their office lifestyle. This is accomplished by sensing the user's active engagement with the system, by detecting user's movement through sensing zones (e.g., 750*b*, 753*b*, 757*b*, and 755*b*), and the use of a controller and specialized firmware that are configured to help the operator/user to stand gradually and more often during their daily routine until the optimal daily recommended time is reached. The variable height platform system accomplishes this through the use of an arrangement of surface movement sensors which tracks a user's activity into and through certain sensor zones (e.g., 750*b*, 753*b*, 757*b*, and 755*b*) in such a way as to detect the operator's engagement and usage of the variable height platform system. This detection method allows for an accurate determination of activity and actual engagement with the variable height platform system versus just presence or proximity around the variable height platform system. This detection of actual activity and engagement gives a more accurate determination as to when the variable height platform system should signal to the operator/user when they should change their current state (e.g., when to stand and when to sit). The accurate sensing and tracking of the active engagement and the ability to compare the readings against the operator's activity preferences while taking into consideration the operator's experience curve will help to ensure the variable height platform system properly recommends when the operator should change states/positions. These recommendations can be determined by the following, or any combination of the following: sensor readings, position of the variable height platform system, how much active time they have spent at certain positions as compared to the operators experience curve and their preference settings. This feature ensures that the users do not under-use or over-use the variable height platform system from the point they first use the variable height platform system to the point when they have become an experienced operator.

The controller may also be configured to produce/generate an alarm in response to the determination that the one or more components of the variable height platform system 100 are not functioning in accordance with the predetermined criteria. The variable height platform system 100 may include the control panel/user interface. The user interface may be operatively connected to the controller and is configured to display information (e.g., operational performance) of the variable height platform system 100 to a user, and/or solicit information from the user (e.g., allow the user to enter data and/or other parameters of the variable height platform system 100). The control panel/user interface is configured to be operatively connected to the variable height platform system to control the operation of the variable height platform system. The control panel/user interface may include one or more buttons or other controls that allow the user to modify one or more parameters of the variable height platform system 100. For example, the one or more buttons or other controls of the user interface may be operated by touch or tactile manipulation or mechanical type control.

The control panel/user interface resides on the variable height platform system 100 to provide feedback about the state of operation of the variable height platform system 100 to the user. The control panel/user interface may optionally have input controls for the user. The input controls of the user interface may change the orientation of, and/or the information displayed thereon. The control panel/user interface is configured to display one or more of the following data: sensor readings, operational state of the variable height platform system 100, etc. The control panel/user interface is configured to display sensor data in an easily understandable format to the user. Based on the displayed data/information, the user can observe the variable height platform system's state of operation and its effectiveness, and/or the user can determine if the settings of the variable height platform system 100 are optimized. The control panel/user interface may be hardwired or wireless. The control panel/user interface may be battery powered or may be powered by the power source of the variable height platform system. The control panel/user interface may include a controller therein.

The receivers and the transmitters of the variable height platform system 100 are configured to establish a communication link or communication network between the controller(s), the user interface/control panel(s), the sensor(s), and the drive mechanism(s) of the variable height platform system 100 prior to the transmission of information or signals. The communication network may include any communication network such as the telephone network, wide area network, local area network, Internet or wireless communication network. Examples of wireless communications may include Bluetooth, RF, Wi-Fi, infrared, ultrasonic, or any other wireless connection.

The present patent application and its various embodiments as described above uniquely address the observed, noted and researched findings and improve on the prior and current state of the art sit/stand tables and desks. The listed products, features and embodiments as described in the present patent application should not be considered as limiting in any way. The disclosed features and embodiments of the present patent application can be applied to a range of products that are moving platform based products.

Although the present patent application has been described in detail for the purpose of illustration, it is to be understood that such detail is solely for that purpose and that the present patent application is not limited to the disclosed embodiments, but, on the contrary, is intended to cover modifications and equivalent arrangements that are within the spirit and scope of the appended claims. In addition, it is to be understood that the present patent application contemplates that, to the extent possible, one or more features of any embodiment can be combined with one or more features of any other embodiment.

The illustration of the embodiments of the present patent application should not be taken as restrictive in any way since a myriad of configurations and methods utilizing the present patent application can be realized from what has been disclosed or revealed in the present patent application. The systems, features and embodiments described in the present patent application should not be considered as limiting in any way. The illustrations are representative of possible construction and mechanical embodiments and methods to obtain the desired features. The location and/or the form of any minor design detail or the material specified in the present patent application can be changed and doing so will not be considered new material since the present patent application covers those executions in the broadest form.

The foregoing illustrated embodiments have been provided to illustrate the structural and functional principles of the present patent application and are not intended to be limiting. To the contrary, the present patent application is intended to encompass all modifications, alterations and substitutions within the spirit and scope of the appended claims.

What is claimed is:

1. A variable height platform system comprising:

a frame assembly extending longitudinally along a longitudinal axis, the frame assembly configured to support and to be removably connected to one of a plurality of different tabletops, the frame assembly configured to be adjustable along the longitudinal axis to accommodate the plurality of different tabletops, wherein the size of a first of the plurality of different tabletops is different from the size of a second of the plurality of different tabletops;

at least two leg assemblies, each leg assembly configured to be pivotally connected to a portion of the frame assembly, each leg assembly configured to be movable between a deployed position in which each leg assembly is configured to be substantially perpendicular to the longitudinal axis of the frame assembly so as to support the frame assembly in an elevated position for use, and a storage position in which each leg assembly is configured to be folded flat against the frame assembly and essentially parallel to the longitudinal axis of the frame assembly, a drive mechanism configured to either extend or retract each leg assembly in a direction substantially perpendicular to the longitudinal axis to set a height of the frame assembly in the elevated position; and a connector assembly disposed on the frame assembly and configured to detachably lock one of the plurality of different tabletops to the frame assembly, wherein the plurality of different tabletops are interchangeable such that the first of the plurality of different tabletops, detachably locked to the frame assembly by the connector assembly, is removed from the frame assembly by unlocking the connector assembly, the frame assembly is then adjusted along the longitudinal axis to accommodate the second of the plurality of different tabletops, and the second of the plurality of different tabletops is positioned on the frame assembly and detachably locked to the frame assembly by the connector assembly, wherein a thickness of the first of the plurality of different tabletops is different from a thickness of the second of the plurality of different tabletops, and wherein the thicknesses of the first and the second of the plurality of different tabletops are measured perpendicular to the longitudinal axis, and wherein the connector assembly is configured to be adjustable, in the direction along which each leg assembly either extends or retracts, to accommodate the different thicknesses of the first and the second of the plurality of different tabletops.

2. The variable height platform system of claim 1, wherein a length of the first of the plurality of different tabletops is different from a length of the second of the plurality of different tabletops, and wherein the lengths of the first and the second of the plurality of different tabletops are measured along the longitudinal axis.

3. The variable height platform system of claim 1, further comprising at least two latches, each latch configured to be biased into a lock position wherein it releasably engages with a lock engagement portion of an associated leg assembly when that leg assembly in its deployed position.

4. The variable height platform system of claim 3, wherein each latch includes an eccentrically mounted latch member and a latch handle, and wherein the eccentrically mounted latch member is configured to releasably engage with the lock engagement portion of the associated leg assembly, when that leg assembly in its deployed position, so as to lock the associated leg assembly in its deployed position.

5. The variable height platform system of claim 4, wherein a movement of the latch handle from a first position to a second position is configured to further secure the engagement between the latch member and the latch engagement portion.

6. The variable height platform system of claim 1, wherein a width of the first of the plurality of different tabletops is the same as a width of the second of the plurality of different tabletops, and wherein the widths of the first and the second of the plurality of different tabletops are measured perpendicular to the longitudinal axis.

7. The variable height platform system of claim 1, further comprising a retainer assembly that is configured to releasably engage with a portion of an associated leg assembly when that leg assembly in its storage position so as to lock that leg assembly in its storage position.

8. The variable height platform system of claim 1, wherein the connector assembly is permanently attached to the frame assembly.

9. The variable height platform system of claim 1, wherein the connector assembly is guided by the frame assembly.

10. A variable height platform system comprising:

a tabletop;

a frame assembly extending longitudinally along a longitudinal axis, the frame assembly configured to support and be removably connected to the tabletop;

at least two leg assemblies, each leg assembly configured to be connected to a portion of the frame assembly, a drive mechanism configured to either extend or retract each leg assembly in a direction substantially perpendicular to the longitudinal axis to set a height of the frame assembly in an elevated position for use;

a sensor configured to sense position and movement of a user in a predetermined area including an area of the variable height platform system and an area proximate the variable height platform system; and a controller operatively connected to the sensor and drive mechanism, the controller configured to operate the drive mechanism in response to the sensor sensing the position and movement of the user in the predetermined area.

11. The variable height platform system of claim 10, wherein the sensor is configured to sense the position and movement of the user on the tabletop, along a length of the tabletop and a width of the tabletop.

12. The variable height platform system of claim 10, wherein the sensor is disposed on an underside of the tabletop and the sensor is configured to sense the position and movement of the user through a thickness of the tabletop.

13. The variable height platform system of claim 10, wherein the sensor is configured to sense the position and movement of the user across an area of the tabletop.

14. The variable height platform system of claim 10, wherein the sensor is disposed on a top surface portion of the frame assembly and the sensor is configured to sense the position and movement of the user through a thickness of the tabletop.

15. The variable height platform system of claim 10, wherein the sensor is a capacitive sensor.

16. A variable height platform system comprising:

a tabletop;

a frame assembly extending longitudinally along a longitudinal axis, the frame assembly configured to support and be removably connected to the tabletop;

at least two leg assemblies, each leg assembly configured to be connected to a portion of the frame assembly, a drive mechanism configured to either extend or retract each leg assembly in a direction substantially perpendicular to the longitudinal axis to set a height of the frame assembly in an elevated position for use;

a sensor configured to sense position and movement of a user in a predetermined area that is on the tabletop and proximate the tabletop; and a controller operatively connected to the sensor and drive mechanism, the controller configured to operate the drive mechanism in response to the sensor sensing the position and movement of the user in the predetermined area.

17. The variable height platform system of claim 16, wherein the sensor is a capacitive sensor.

18. A variable height platform system comprising:

a tabletop;

a frame assembly extending longitudinally along a longitudinal axis, the frame assembly configured to support and be removably connected to the tabletop;

at least two leg assemblies, each leg assembly configured to be connected to a portion of the frame assembly, a drive mechanism configured to either extend or retract each leg assembly in a direction substantially perpendicular to the longitudinal axis to set a height of the frame assembly in an elevated position for use;

a capacitive sensor configured to sense position and movement of a user in a predetermined three-dimensional region proximate the tabletop; and a controller operatively connected to the capacitive sensor and drive mechanism, the controller configured to operate the drive mechanism in response to the capacitive sensor sensing the position and movement of the user in the predetermined three-dimensional region.

19. The variable height platform system of claim 18, wherein the predetermined three-dimensional region includes an area that is on the tabletop.

20. A variable height platform system comprising:

a frame assembly extending longitudinally along a longitudinal axis, the frame assembly configured to support and to be removably connected to a tabletop, at least two leg assemblies, each leg assembly configured to be pivotally connected to a portion of the frame assembly, each leg assembly configured to be movable between a deployed position in which each leg assembly is configured to be substantially perpendicular to the longitudinal axis of the frame assembly so as to support the frame assembly in an elevated position for use, and a storage position in which each leg assembly is configured to be folded flat against the frame assembly and essentially parallel to the longitudinal axis of the frame assembly, a drive mechanism configured to either extend or retract each leg assembly in a direction substantially perpendicular to the longitudinal axis to set a height of the frame assembly in the elevated position; and an overcenter latch comprising a latch member and a latch handle, the overcenter latch configured to be spring-biased into a lock position wherein the latch member is resiliently biased to releasably engage with a lock engagement portion of an associated leg assembly, when that leg assembly in its deployed position, so as to lock the associated leg assembly in its deployed position, wherein a movement of the latch handle from a first position to a second position is configured to further secure the engagement between the latch member and the latch engagement portion.

* * * * *